US007552810B2

(12) United States Patent
Mecklenburg

(10) Patent No.: US 7,552,810 B2
(45) Date of Patent: Jun. 30, 2009

(54) SENSOR AND METHOD FOR DISCRIMINATING COINS USING FAST FOURIER TRANSFORM

(75) Inventor: David J. Mecklenburg, Glendale Heights, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 374 days.

(21) Appl. No.: 10/963,314

(22) Filed: Oct. 12, 2004

(65) Prior Publication Data

US 2005/0045450 A1 Mar. 3, 2005

Related U.S. Application Data

(63) Continuation of application No. 10/095,256, filed on Mar. 11, 2002, now Pat. No. 6,892,871.

(51) Int. Cl.
*G07D 5/08* (2006.01)

(52) U.S. Cl. ..... 194/317; 194/320; 702/38

(58) Field of Classification Search ..... 194/317, 194/224, 302, 318, 319, 320; 73/163; 324/600, 324/602, 605, 606–609
See application file for complete search history.

(56) References Cited

U.S. PATENT DOCUMENTS

| | | | |
|---|---|---|---|
| 3,771,583 | A | 11/1973 | Bottemiller |
| 4,124,111 | A | 11/1978 | Hayashi |
| 4,184,366 | A | 1/1980 | Butler |
| 4,228,812 | A | 10/1980 | Marti |
| 4,436,103 | A | 3/1984 | Dick |
| 4,474,197 | A | 10/1984 | Kinoshita et al. |

(Continued)

FOREIGN PATENT DOCUMENTS

| | | | |
|---|---|---|---|
| EP | 1 104 920 | A1 | 6/2001 |

(Continued)

OTHER PUBLICATIONS

"The Electrical Engineering Handbook", 2nd Ed. Published by CRC Press and IEEE in 1997, Edited by Richard C. Dorf, pp. 23-31.

(Continued)

*Primary Examiner*—Patrick Mackey
*Assistant Examiner*—Mark Beauchaine
(74) *Attorney, Agent, or Firm*—Nixon Peabody LLP

(57) ABSTRACT

A coin discrimination sensor having an excitation coil and two detector coils arranged to detect eddy currents in a passing coin. The excitation coil is provided a composite waveform formed by adding a low frequency signal (30 KHz) with a high frequency signal (480 KHz). The two detector coils are arranged at different distances from the passing coin, and are calibrated to eliminate the common-mode voltage when no coin is present. As a coin passes by the sensor, eddy currents are induced in the coin which result in phase and amplitude shifts in the low and high frequency components of the detector signal. The low and high frequency components are separated from the detector signal, and their respective phases and amplitudes are ascertained and compared against values stored in a lookup table. These values represent the composition, thickness, and diameter characteristics of known coins, and if the signature of the processed coin does not appear in the lookup table, it can be flagged as an invalid coin.

39 Claims, 18 Drawing Sheets

U.S. PATENT DOCUMENTS

| | | | | |
|---|---|---|---|---|
| 4,488,116 | A | 12/1984 | Plesko | |
| 4,556,140 | A | 12/1985 | Okada | |
| 4,564,036 | A | 1/1986 | Ristvedt | |
| 4,607,649 | A | 8/1986 | Taipale et al. | |
| 4,681,128 | A | 7/1987 | Ristvedt et al. | |
| 4,705,154 | A | 11/1987 | Masho et al. | |
| 4,731,043 | A | 3/1988 | Ristvedt et al. | |
| 4,749,074 | A | 6/1988 | Ueki et al. | |
| 4,753,624 | A | 6/1988 | Adams et al. | |
| 4,753,625 | A | 6/1988 | Okada | |
| 4,863,414 | A | 9/1989 | Ristvedt et al. | |
| 4,936,435 | A | 6/1990 | Griner | |
| 4,971,187 | A | 11/1990 | Furuya et al. | |
| 5,022,889 | A | 6/1991 | Ristvedt et al. | |
| 5,026,320 | A | 6/1991 | Rasmussen | |
| 5,141,443 | A | 8/1992 | Rasmussen et al. | |
| 5,236,071 | A | 8/1993 | Lee | |
| 5,263,566 | A | 11/1993 | Nara et al. | |
| 5,277,651 | A | 1/1994 | Rasmussen et al. | |
| 5,299,977 | A | 4/1994 | Mazur et al. | |
| 5,345,206 | A | 9/1994 | Morcos | |
| 5,379,875 | A | 1/1995 | Shames et al. | |
| 5,382,191 | A | 1/1995 | Rasmussen | |
| 5,429,550 | A | 7/1995 | Mazur et al. | |
| 5,453,047 | A | 9/1995 | Mazur et al. | |
| 5,480,348 | A | 1/1996 | Mazur et al. | |
| 5,507,379 | A | 4/1996 | Mazur et al. | |
| 5,542,880 | A | 8/1996 | Geib et al. | |
| 5,630,494 | A * | 5/1997 | Strauts | 194/317 |
| 5,743,373 | A | 4/1998 | Strauts | |
| 5,823,315 | A | 10/1998 | Hoffman et al. | |
| 5,988,348 | A | 11/1999 | Martin et al. | |
| 5,992,602 | A | 11/1999 | Zweig et al. | |
| 6,047,808 | A | 4/2000 | Neubarth et al. | |
| 6,056,104 | A | 5/2000 | Neubarth et al. | |
| 6,080,056 | A | 6/2000 | Karlsson | |
| 6,171,182 | B1 | 1/2001 | Geib et al. | |
| 6,182,962 | B1 | 2/2001 | Leuthold | |
| 6,196,371 | B1 | 3/2001 | Martin et al. | |
| 6,264,545 | B1 | 7/2001 | Magee et al. | |
| 6,412,620 | B1 | 7/2002 | Imura | |
| 6,431,342 | B1 | 8/2002 | Schwartz | |
| 6,471,030 | B1 | 10/2002 | Neubarth et al. | |
| 6,503,138 | B2 | 1/2003 | Spoehr et al. | |
| 6,705,448 | B1 * | 3/2004 | Steel | 194/302 |
| 6,755,730 | B2 | 6/2004 | Geib et al. | |
| 6,766,892 | B2 * | 7/2004 | Martin et al. | 194/317 |
| 2002/0074209 | A1 | 6/2002 | Karlsson | |

FOREIGN PATENT DOCUMENTS

| | | |
|---|---|---|
| GB | 2 121 582 A | 12/1983 |
| GB | 2 160 689 | 12/1985 |
| WO | 93/02431 | 2/1993 |
| WO | 97/25692 | 7/1997 |
| WO | 99/33030 | 7/1999 |

OTHER PUBLICATIONS

Billcon Corporation, Brochure for CCS-60/CCS-80 Series Coin Counter-Sorter, 2 pages (Oct. 1999).

Billcon Corporation, Photos for CCS-60/80, 1 page (Japanese language) (Oct. 12, 2000).

Complaint, *Cummins-Allison Corp.* v. *Glory Ltd., Glory Shoji Co. Ltd., and Glory (U.S.A.) Inc.*, Civil Action No. 02C-7008, United States District Court, Northern District of Illinois, Eastern Division.

De La Rue Cash Systems, Brochure for MACH 12 Coin Sorter/Counter, 2 pages (1999).

De La Rue Cash Systems, Brochure for MACH 12HD Coin Sorter/Counter, 2 pages (no date).

De La Rue Cash Systems, Inc., Brochure for ACD Automatic Coin Dispenser, 2 pages (no date).

Glory, Brochure for GSA-500 Sortmaster, 2 pages (no date).

Magner, Brochure for 900 Series Coin Counters and Packagers, 2 pages (no date).

Magner, Brochure for COINSTREAM™ CPS 502 Self-Service Coin Processing System, 2 pages (no date).

Magner, Brochure for MAG II 100 Series Coin Sorters, 2 pages (no date).

Magner, Brochure for MAG II Model 915 Coin Counter/Packager, 2 pages (no date).

Magner, Brochure for Pelican 305 Coin Sorter, 2 pages (no date).

PCT International Search Report for International Application No. PCT/US03/06762 dated May 23, 2003 (3 pages).

* cited by examiner

SENSOR AND METHOD FOR DISCRIMINATING COINS USING FAST FOURIER TRANSFORM

CROSS-REFERENCE TO RELATED APPLICATION

This application is a continuation of U.S. application Ser. No. 10/095,256, entitled "Sensor and Method for Discriminating Coins of Varied Thickness and Diameter," filed on Mar. 11, 2002, and issued on May 17, 2005, as U.S. Pat. No. 6,892,871, U.S. application Ser. No. 10/095,256 is incorporated by reference in its entirety. This application is related to commonly assigned U.S. patent application Ser. No. 10/095,164, filed Mar. 11, 2002, and issued on Jun. 29, 2004, as U.S. Pat. No. 6,755,730, which is incorporated herein by reference in its entirety.

FIELD OF THE INVENTION

The present invention relates generally to coin discrimination sensors for discriminating coins, tokens, and the like of mixed denominations. More particularly, the present invention relates to a coin discrimination sensor that discriminates among coins of different compositions, thickness, and diameters.

BACKGROUND OF THE INVENTION

Coin discrimination sensors have been employed to discriminate among various coins. A typical coin discrimination sensor includes at least one primary coil for inducing eddy currents in the coin to be analyzed. The primary coil receives an alternating voltage which correspondingly produces an alternating current in the coil. The alternating current flowing in the primary coil produces an alternating magnetic field through and around the coil as is well known in the art.

Characteristics of the alternating magnetic field depend upon a variety of factors including the frequency and amplitude of the voltage applied to the primary coil. The primary coil, also known as the excitation coil, inductively couples with a coin brought into proximity with the coil, thereby producing eddy currents in the coin being analyzed. Because the magnetic field from the primary coil is alternating, the corresponding eddy currents are alternating as well. The induced eddy currents are influenced by the characteristics of the coin being analyzed.

The magnitude of the eddy currents produced is influenced by the frequency of the alternating magnetic fields applied. High frequencies tend to create magnetic fields that penetrate near the surface of the coin, giving a better indication of a coin's surface area. Low frequencies tend to penetrate further into the coin, giving a better indication of a coin's volume. Coin discrimination sensors which employ eddy currents to discriminate among different coins typically use an excitation signal that is oscillating at a single frequency. Thus, coin discrimination sensors having a high-frequency excitation signal distinguish better among coins of different diameter. Conversely, coin discrimination sensors having a low-frequency excitation signal distinguish better among coins of different thickness. What is needed, therefore, is a coin discrimination sensor that uses a composite excitation signal so as to distinguish among coins having different compositions, thicknesses, and diameters.

SUMMARY OF THE INVENTION

A discrimination sensor includes a transmission coil and two reception coils. The transmission coil produces a magnetic field over a section of a coin path along which coins pass. The reception coils are configured to detect signals that are indicative of characteristics of each coin passing along the coin path. The characteristics include at least a coin composition, such as metal content, a coin thickness, and a coin diameter.

According to another embodiment, a discrimination sensor includes a first coil coupled to a second coil. The first coil and the second coil produce a magnetic field over a coin path along which coins pass. The magnetic field couples to the coins to induce eddy currents within a passing coin. The first coil and the second coil also detect signals corresponding to the eddy currents, which signals are indicative of at least a coin composition, a coin thickness, and a coin diameter.

A method according to the present invention includes moving a coin along a coin path, inducing eddy currents in the coin by subjecting the coin to a magnetic field of a high frequency and a low frequency, detecting signals corresponding to the eddy currents that are indicative of a coin composition, a coin thickness, and a coin diameter, and processing the signals to determine an identity of the coin.

The above summary of the present invention is not intended to represent each embodiment, or every aspect, of the present invention. Additional features and benefits of the present invention will become apparent from the detailed description, figures, and claims set forth below.

Figure 1:
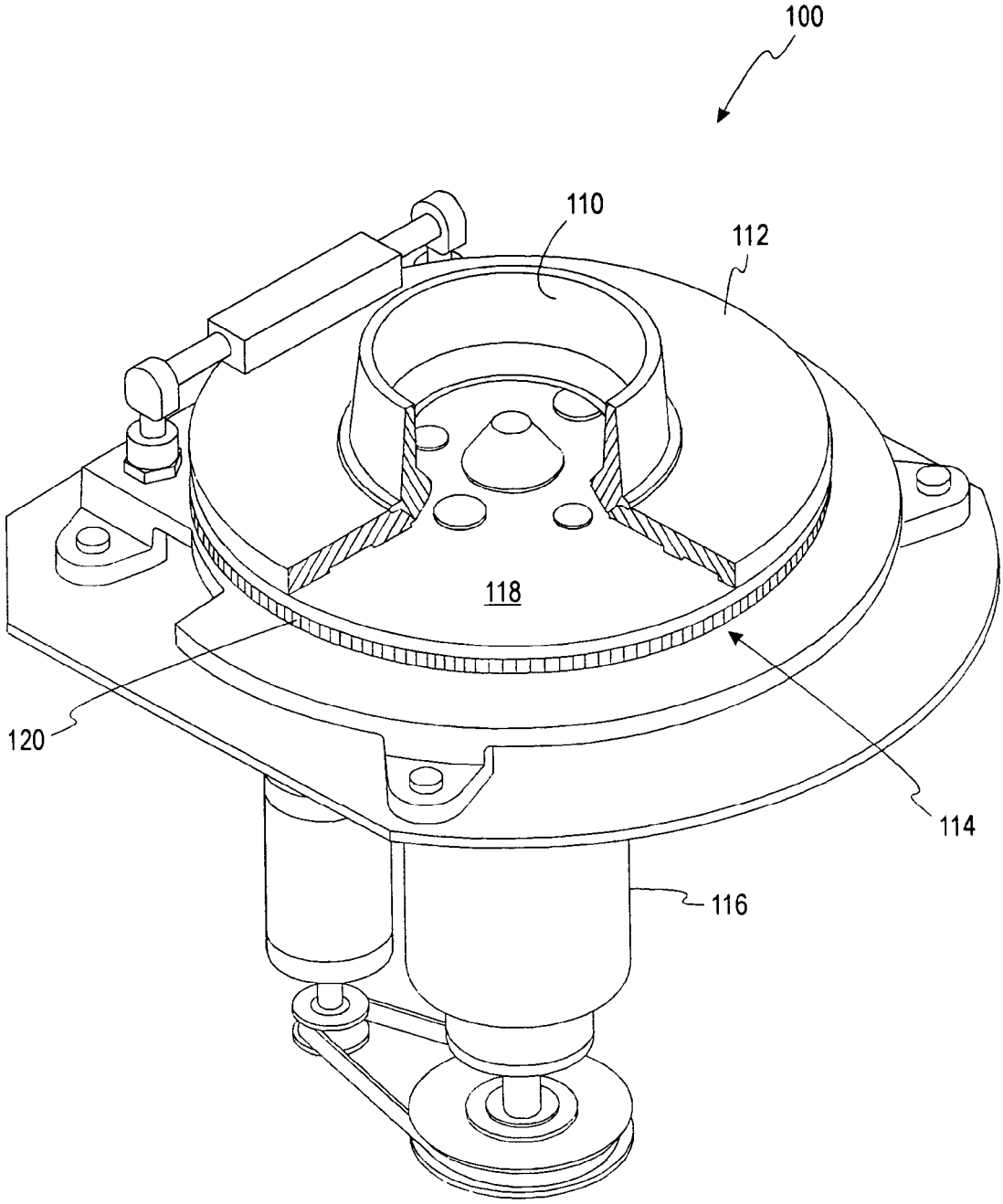
FIG. 1 is a perspective view of a coin processing system, according to one embodiment of the present invention, with portions thereof broken away to show the internal structure.

While the invention is susceptible to various modifications and alternative forms, specific embodiments will be shown by way of example in the drawings and will be desired in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

Although the coin discrimination sensor of the present invention can be used in a variety of devices, it is particularly useful in high-speed coin sorters of the disc type. Thus, the invention will be described with specific reference to the use of disc-type coin sorters as an exemplary device in which the coin discrimination sensor is utilized. However, it is expressly understood that the coin discrimination sensor of the present invention may be used in any device which requires that coins be discriminated. Note that the term "coin" as used herein includes any type of coin, token, or object substituted therefor.

Turning now to the drawings and referring first to FIG. 1, a disc-type coin processing system 100 according to one embodiment of the present invention is shown. The coin processing system 100 includes a hopper 110 for receiving coins of mixed denominations that feeds the coins through a central opening in an annular sorting head 112. As the coins pass through this opening, they are deposited on the top surface of a rotatable disc 114. This rotatable disc 114 is mounted for rotation on a shaft (not shown) and driven by an electric motor 116. The disc 114 typically comprises a resilient pad 118, preferably made of a resilient rubber or polymeric material, bonded to the top surface of a solid disc 120. While the solid disc 120 is often made of metal, it can also be made of a rigid polymeric material.

According to one embodiment, coins are initially deposited by a user in a coin tray (not shown) disposed above the coin processing system 100 shown in FIG. 1. The user lifts the coin tray which funnels the coins into the hopper 110. A coin tray suitable for use in connection with the coin processing system 100 is described in detail in U.S. Pat. No. 4,964,495 entitled "Pivoting Tray For Coin Sorter," which is incorporated herein by reference in its entirety.

As the disc 114 is rotated, the coins deposited on the resilient pad 118 tend to slide outwardly over the surface of the pad 118 due to centrifugal force. As the coins move outwardly, those coins which are lying flat on the pad 118 enter the gap between the surface of the pad 118 and the sorting head 112 because the underside of the inner periphery of the sorting head 112 is spaced above the pad 118 by a distance which is about the same as the thickness of the thickest coin. As is further described below, the coins are processed and sent to exit stations where they are discharged. The coin exit stations may sort the coins into their respective denominations and discharge the coins from exit channels in the sorting head 112 corresponding to their denominations.

Figure 2:
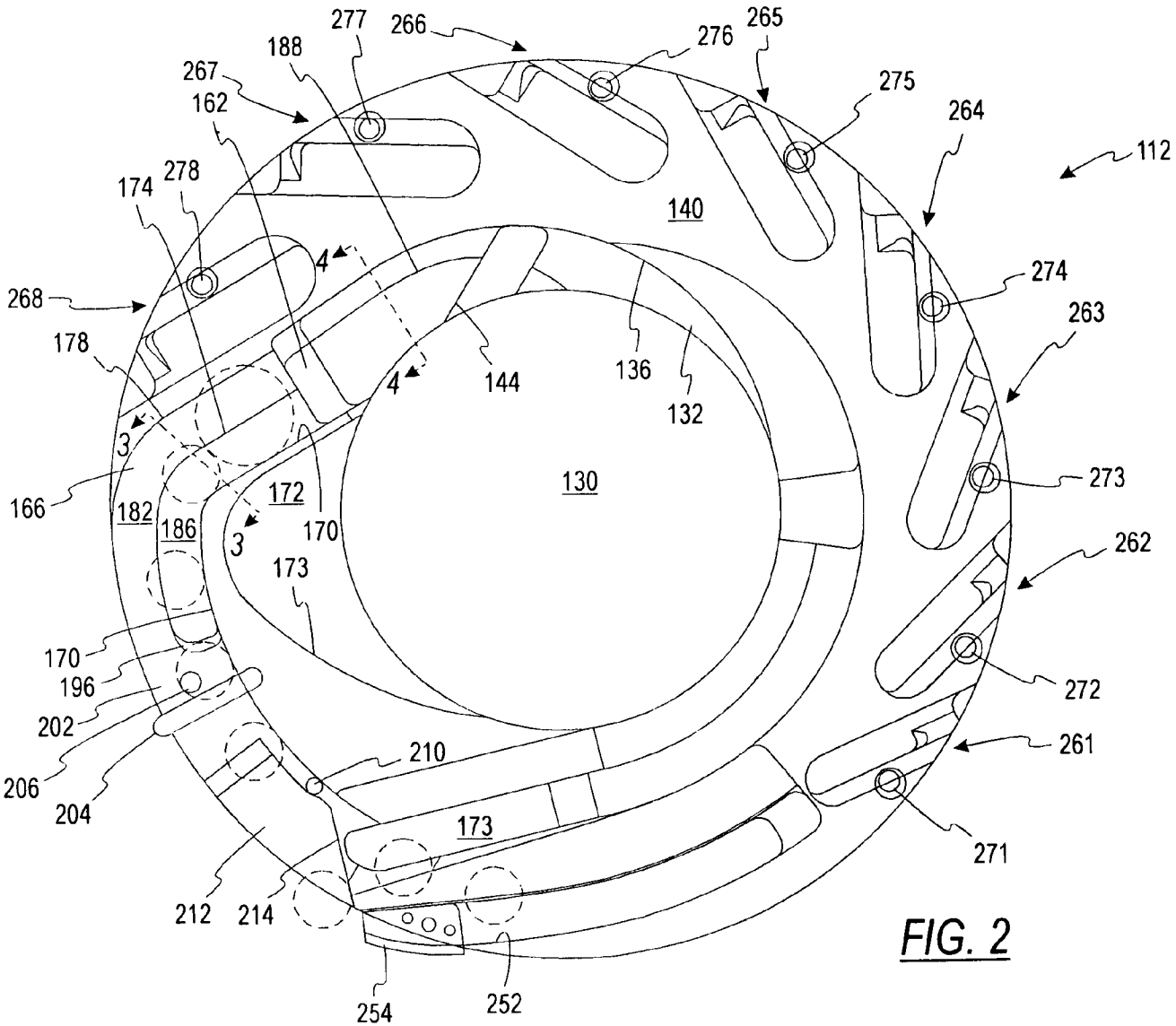
FIG. 2 is an enlarged bottom view of a sorting head for use with the system of FIG. 1.

Referring now to FIG. 2, the underside of the sorting head 112 is shown. The coin sets for any given country are sorted by the sorting head 112 due to variations in the diameter size. The coins circulate between the sorting head 112 and the pad 118 (FIG. 1) on the rotatable disc 114 (FIG. 1). The coins are deposited on the pad 118 via a central opening 130 and initially enter the entry channel 132 formed in the underside of the sorting head 112. It should be keep in mind that the circulation of the coins in FIG. 2 appears counterclockwise as FIG. 2 is a view of the underside of the sorting head 112.

An outer wall 136 of the entry channel 132 divides the entry channel 132 from the lowermost surface 140 of the sorting head 1112. The lowermost surface 140 is preferably spaced from the pad 118 by a distance that is slightly less than the thickness of the thinnest coins. Consequently, the initial outward radial movement of all the coins is terminated when the coin engage the outer wall 136, although the coins continue to move more circumferentially along the wall 136 (in the counterclockwise directed as viewed in FIG. 2) by the rotational movement imparted to the coins by the pad 118 of the rotatable disc 114.

In some cases, coins may be stacked on top of each other—commonly referred to as "stacked" coins or "shingled" coins. Some of these coins, particularly thicker coins, will be under pad pressure and cannot move radially outward toward wall 136 under the centrifugal force. Stacked coins which are not against wall 136 must be recirculated and stacked coins in contact against wall 136 must be unstacked. To unstack the coins, the stacked coins encounter a stripping notch 144 whereby the upper coin of the stacked coins engages the stripping notch 144 and is channeled along the stripping notch 144 back to an area of the pad 118 disposed below the central opening 130 where the coins are then recirculated. The vertical dimension of the stripping notch 144 is slightly less the thickness of the thinnest coins so that only the upper coin is contacted and stripped. While the stripping notch 144 prohibits the further circumferential movement of the upper coin, the lower coin continues moving circumferentially across stripping notch 144 into the queuing channel 166.

Stacked coins that may have bypassed the stripping notch 144 by entering the entry channel 132 downstream of the stripping notch 144 are unstacked after the coins enter the queuing channel 166 and are turned into an inner queuing wall 170 of the queuing channel 166. The upper coin contacts the inner queuing wall 170 and is channeled along the inner queuing wall 170 while the lower coin is move by the pad 118 across the inner queuing wall 170 into the region defined by surface 172 wherein the lower coin engages a wall 173 and is recirculated. Other coins that are not properly aligned along the inner queuing wall 170, but that are not recirculated by wall 173, are recirculated by recirculating channel 173.

As the pad 118 continues to rotates, those coins that were initially aligned along the wall 136 (and the lower coins of stacked coins moving beneath the stripping notch 144) move across the ramp 162 leading to the queuing channel 166 for aligning the innermost edge of each coin along an inner queuing wall. In addition to the inner queuing wall 170, the queuing channel 166 includes a first rail 174 and a second rail 178 that form the outer edges of stepped surfaces 182 and 186, respectively. The stepped surfaces 182, 186 are acutely angled with respect to the horizontal. The surfaces 182 and 186 are sized such that the width of surface 182 is less than that of the smallest (in terms of the diameter) coins and the width of surface 184 is less than that of the largest coin.

Figure 3:
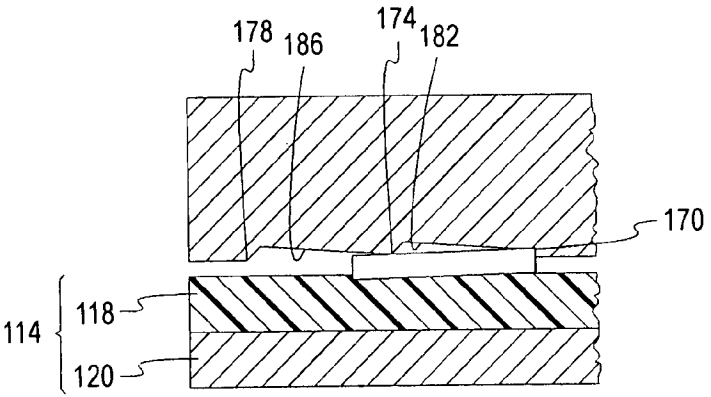
FIG. 3 is a cross-sectional view of the sorting head shown in FIG. 2 taken along line 3-3.

Referring for a moment to FIG. 3, a small diameter coin (e.g., a dime or a 1¢ Euro coin) is shown pressed into pad 118 by the first rail 174 of the sorting head 112. The rails 174, 178 are dimensioned to be spaced away from the top of the pad 118 by a distance less than the thickness of the thinnest coin so that the coins are gripped between the rail 174, 178 and the pad 118 as the coins move through the queuing channel 166. The coins are actually slightly tilted with respect to the sorting head 112 such that their outermost edges are digging into the pad 118. Consequently, due to this positive pressure on the outermost edges, the innermost edges of the coins tend to rise slightly away from the pad 118.

Referring back to FIG. 2, the coins are gripped between one of the two rails 174, 178 and the pad 118 as the coins are rotated through the queuing channel 166. The coins, which were initially aligned with the outer wall 136 of the entry channel 130 as the coins moved across the ramp 162 and into the queuing channel 166, are rotated into engagement with inner queuing wall 170. Because the queuing channel 166 applies a greater amount of pressure on the outside edges of the coins, the coin are less likely to bounce off the inner queuing wall 170 as the radial position of the coin is increased along the inner queuing wall 170.

Figure 4B:
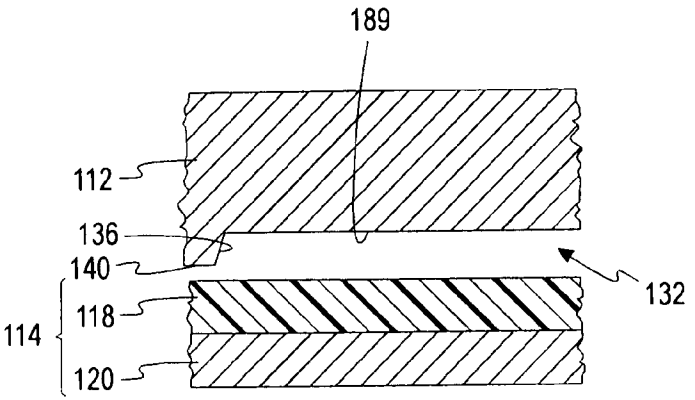
FIG. 4*b* is a cross-sectional view of an alternative embodiment of that which is shown in FIG. 4*a;*
Figure 4A:
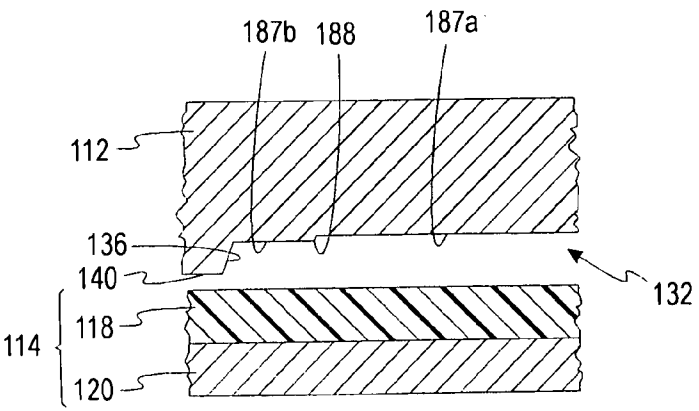
FIG. 4*a* is a cross-sectional view of the sorting head shown in FIG. 2 taken along 4-4.

Referring to FIG. 4*a*, the entry region 132 of the embodiment of the sorting head 112 shown in FIG. 2 includes two stepped surfaces 187*a*, 187*b* forming a rail 188 therebetween. According to an alternative embodiment of the sorting head 112, the entry channel 132 consists of one surface 189 as shown in FIG. 4*b*.

Figure 5:
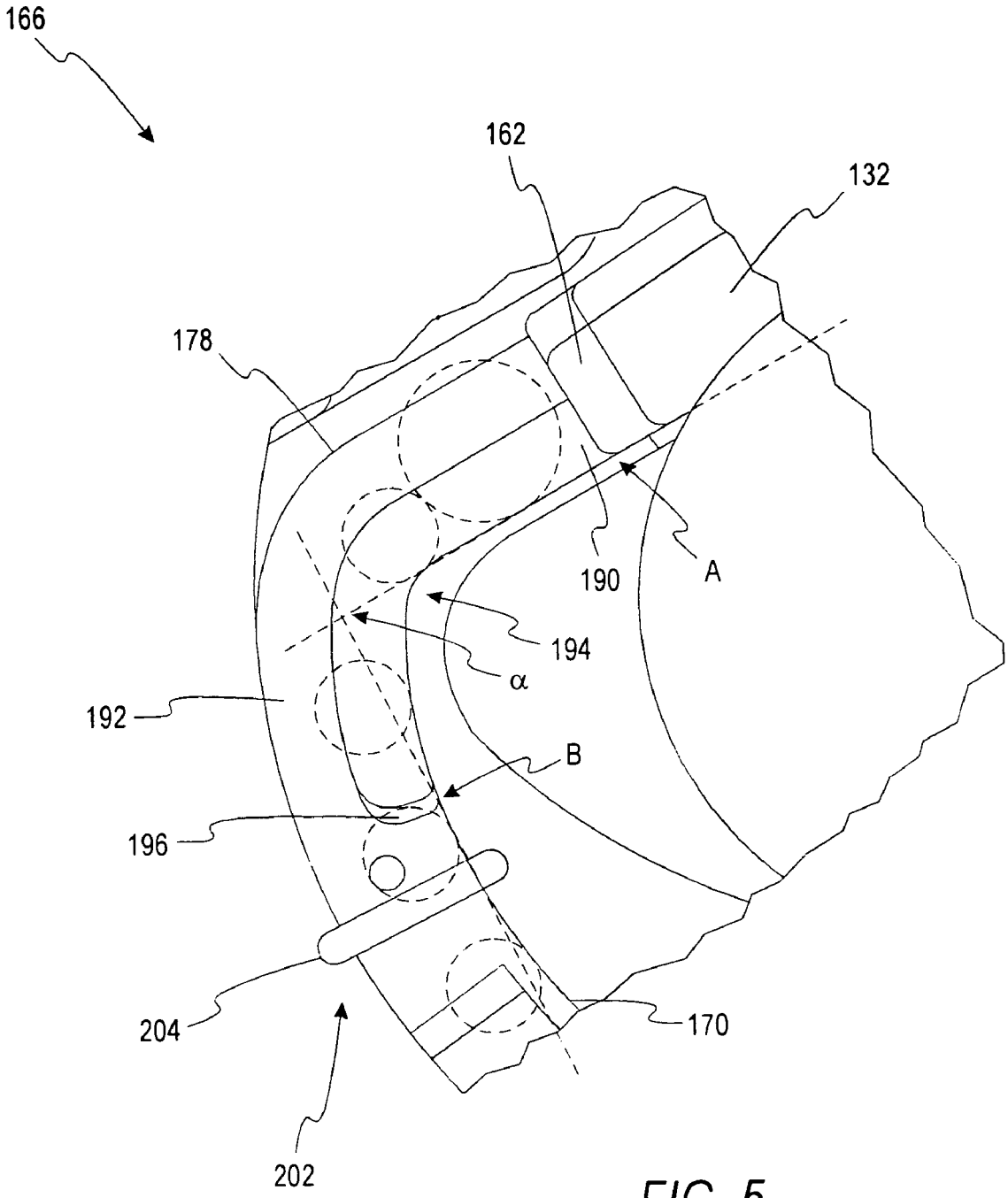
FIG. 5 is a cross-sectional view of the sorting head shown in FIG. 2 taken along line 5-5.

Referring now to FIG. 5, there is shown an oversized view of the queuing channel 166 of FIG. 2. It can be seen that the queuing channel 166 is generally "L-shaped." The L-shaped shaped queuing channel 166 is considered in two segments—a first upstream segment 190 and a second downstream segment 192. The upstream segment 190 receives the coins as the coins move across the ramp 162 and into the queuing channel 166. The coins enter the downstream segment 192 as the coins turn a corner 194 of the L-shaped queuing channel 166. As the pad 118 continues to rotate, the coins move along the second segment 192 and are still engaged on the inner queuing wall 170. The coins move across a ramp 196 as the coins enter a discrimination region 202 and a reject region having a reject channel 212 for off-sorting invalid coins, which are both located towards the downstream end of the second segment 192. The discrimination region includes a discrimination sensor 204 for discriminating between valid and invalid coins and/or identifying the denomination of coins.

The queuing channel 166 is designed such that a line tangent to the inner queuing wall 170 of the L-shaped queuing channel 166 at about the point where coins move past the ramp 196 into the discrimination region 202 (shown as point A in FIG. 5) forms an angle alpha ($\alpha$) with a line tangent to the inner queuing wall 170 at about the point where coins move over ramp 162 into the queuing channel 166 (shown as point B in FIG. 5). According to one embodiment of the present invention, the angle alpha ($\alpha$) is about 100°. According to alternative embodiments of the coin processing system 100, the angle alpha ($\alpha$) is about 100° ranges between about 90° and about 110°.

As the pad 118 continues to rotates, the L-shaped of the queuing channel 166 imparts spacing to the coins which are initially closely spaced, and perhaps abutting one another, as the coins move across the ramp 162 into the queuing channel 166. As the coins move along the first upstream segment 190 of the queuing channel 166, the coins are pushed against inner queuing wall 170 and travel along the inner queuing wall 170 in a direction that is transverse to (i.e., generally unparallel) the direction in which the pad 118 is rotating. This action aligns the coins against the inner queuing wall 170. However, as the coins round the corner 194 into the second downstream segment 192 of the queuing channel 166, the coins are turned in a direction wherein they are moving with the pad (i.e., in a direction more parallel to the direction of movement of the pad). A coin rounding the corner 194 is accelerated as the coin moves in a direction with the pad; thus, the coin is spaced from the next coin upstream. Put another way, the first segment 190 receives coins from the entry channel 132 and the second segment 192 is disposed in a position that is substantially more in direction of movement of said rotatable disc 114 for creating an increased spacing between adjacent coins. Accordingly, the coins moving through the second segment 192 are spaced apart. According to one embodiment of the present invention, the coins are spaced apart by a time of approximately five milliseconds when the sorting head 112 has an eleven inch diameter and the pad 118 rotates at a speed of approximately three hundred revolutions per minute (300 r.p.m.). According to an alternative embodiment, the coins are spaced apart by a distance of less than about two inches when the sorting head 112 has an eleven inch diameter and the pad 118 rotates at a speed of about 350 r.p.m.

Referring back to FIG. 2, as the coins move into the discrimination region 202 of the second segment 194, the coins move across ramp 196 and transition to a flat surface of the discrimination region 202 as the pad 118 continues to rotate. Put another way, the two stepped surfaces 182, 186 of the queuing channel 166 transition into the flat surface of the discrimination region 202 towards the downstream second segment 194. The pad 118 holds each coin flat against the flat surface of the discrimination region 202 as the coins are moved past the discriminator sensor 204 in the downstream second segment 194.

The sorting head 112 includes a cutout for the discrimination sensor 204. The discrimination sensor 204 is disposed just below the flat surface of the discrimination region 202. Likewise, a coin trigger sensor 206 is disposed just upstream of the discrimination sensor 204 for detecting the presence of a coin. Coins first move over the coin trigger sensor 206 (e.g., a photo detector or a metal proximity detector) which sends a signal to a controller indicating that a coin is approaching the coin discrimination sensor 204.

According to one embodiment, the coin discrimination sensor 204 is adapted to discriminate between valid and invalid coins. As used herein, the term "valid coin" refers to coins of the type to be sorted. As used herein, the term "invalid coin" refers to items being circulated on the rotating disc that are not one of the coins to be sorted. Any truly counterfeit coins (i.e., a slug) are always considered "invalid." According to another alternative embodiment of the present invention, the coin discriminator sensor 204 is adapted to identify the denomination of the coins and discriminate between valid and invalid coins.

Coin discrimination sensors suitable for use with the disc-type coin sorter shown in FIGS. 1 and 2 are describe in detail in U.S. Pat. Nos. 5,630,494 and 5,743,373, both of which are entitled "Coin Discrimination Sensor And Coin Handling System" and are incorporated herein by reference in their entries. Another coin discrimination sensor suitable for use with the present invention is described below.

As discussed above according to one alternative embodiment of the present invention, the discrimination sensor 204 discriminates between valid and invalid coins. Downstream of the discrimination sensor 204 is a diverting pin 210 disposed adjacent inner queuing wall 170 that is movable to a diverting position (out of the page as viewed in FIG. 2) and a home position (into the page as viewed in FIG. 2). In the diverting position, the diverting pin 210 directs coins off of inner queuing wall 170 and into a reject channel 212. The reject channel 212 includes a reject wall 214 that rejected coins abut against as they are off-sorted to the periphery of the sorting head 112. Off-sorted coins are directed to a reject area (not shown). Coin that are not rejected (i.e., valid coins) eventually engage an outer wall 252 of a gauging channel 250 where coins are aligned on a common radius for entry into the coin exit station area as is described in greater detail below.

According to one embodiment of the present invention, the diverting pin 210 is coupled to a voice coil (not shown) for moving the diverting pin between the diverting position and the home position. Using a voice coil in this application is a nontraditional use for voice coils, which are commonplace in acoustical applications as well as in servo-type applications. Typically, a discrete amount of voltage is applied to the voice coil for moving the windings of the voice coil a discrete amount within the voice coil's stroke length—the greater the voltage, the greater the movement. However, the Applicants have discovered that the when the voice coil is "flooded" with a positive voltage, for example, the voice coil rapidly moves the diverting pin 210 coupled thereto to the diverting position (i.e., the end of the voice coil's stroke length) within a very short time period that is less than the time it takes for the coins to move from the discrimination sensor 204 to the diverter pin 210 when increased spacing is encountered due to the queuing channel. The voice coil is then flooded with a negative voltage for rapidly moving the diverting pin 210 windings back to its home position.

A voice coil suitable for use with the present invention is described in U.S. Pat. No. 5,345,206, entitled "Moving Coil Actuator Utilizing Flux-Focused Interleaved Magnetic Circuit," which is incorporated herein by references in its entirety. As an example, a voice coil manufactured by BEI, Technologies, Inc. of San Francisco, Calif., model number LA15-16-024A, can move an eighth-inch (⅛ in) stroke (e.g., from the home position to the diverting position) in approximately 1.3 milliseconds, which is a speed of about 0.1 inch per millisecond, and can provide approximately twenty pounds of force in either direction. Other voice coils are suitable for use with the coin sorting system of FIG. 2.

Other types of actuation devices can be used in alternative embodiments of the present invention. For example, a linear solenoid or a rotary solenoid may be used to move a pin such as diverting pin 210 between a diverting position and a home position.

As the pad 118 continues to rotate, those coins not diverted into the reject channel 212 continue along inner queuing wall 170 to the gauging region 250. The inner queuing wall 170 terminates just downstream of the reject channel 212; thus, the coins no longer abut the inner queuing wall 170 at this point and the queuing channel 166 terminates. The radial position of the coins is maintained, because the coins remain under pad pressure, until the coins contact an outer wall 252 of the gauging region 252. According to one embodiment of the present invention, the sorting head 112 includes a gauging block 254 which extends the outer wall 252 beyond the outer periphery of the sorting head 112; The gauging block 254 is useful when processing larger diameter coins such as casino tokens, $1 coins, 50¢ pieces, etc. that extend beyond he outer periphery of the sorting head 112. According to the embodiment of the sorting head 112 shown in FIG. 2, the gauging channel 250 includes two stepped surfaces to form rails similar to that described above in connection with the queuing channel 166. In alternative embodiments, the gauging channel 250 does not include two stepped surfaces.

The gauging wall 252 aligns the coins along a common radius as the coins approach a series of coin exit channels 261-268 which discharge coins of different denominations. The first exit channel 261 is dedicated to the smallest coin to be sorted (e.g., the dime in the U.S. coin set). Beyond the first exit channel 261, the sorting head 112 shown in FIG. 2 forms seven more exit channels 261-268 which discharge coins of different denominations at different circumferential locations around the periphery of the sorting head 112. Thus, the exit channels 261-268 are spaced circumferentially around the outer periphery of the sorting head 112 with the innermost edges of successive channels located progressively closer to the center of the sorting head 112 so that coins are discharged in the order of decreasing diameter. The number of exit channels can vary according to alternative embodiments of the present invention.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 118. To maintain a constant radial position of the coins, the pad 118 continues to exert pressure on the coins as they move between successive exit channels 261-268.

According to one embodiment of the sorting head 112, each of the exit channels 261-268 includes a coin counting sensor 271-278 for counting the coins as coins pass though and are discharged from the coin exit channels 261-268. In an embodiment of the coin processing system utilizing a discrimination sensor capable of determining the denomination of each of the coins, it is not necessary to use the coin counting sensors 271-278 because the discrimination sensor 204 provides a signal that allows the controller to determine the denomination of each of the coins. Through the use of the system controller (FIG. 6), a count is maintained of the number of coins discharged by each exit channel 261-268.

Figure 6:
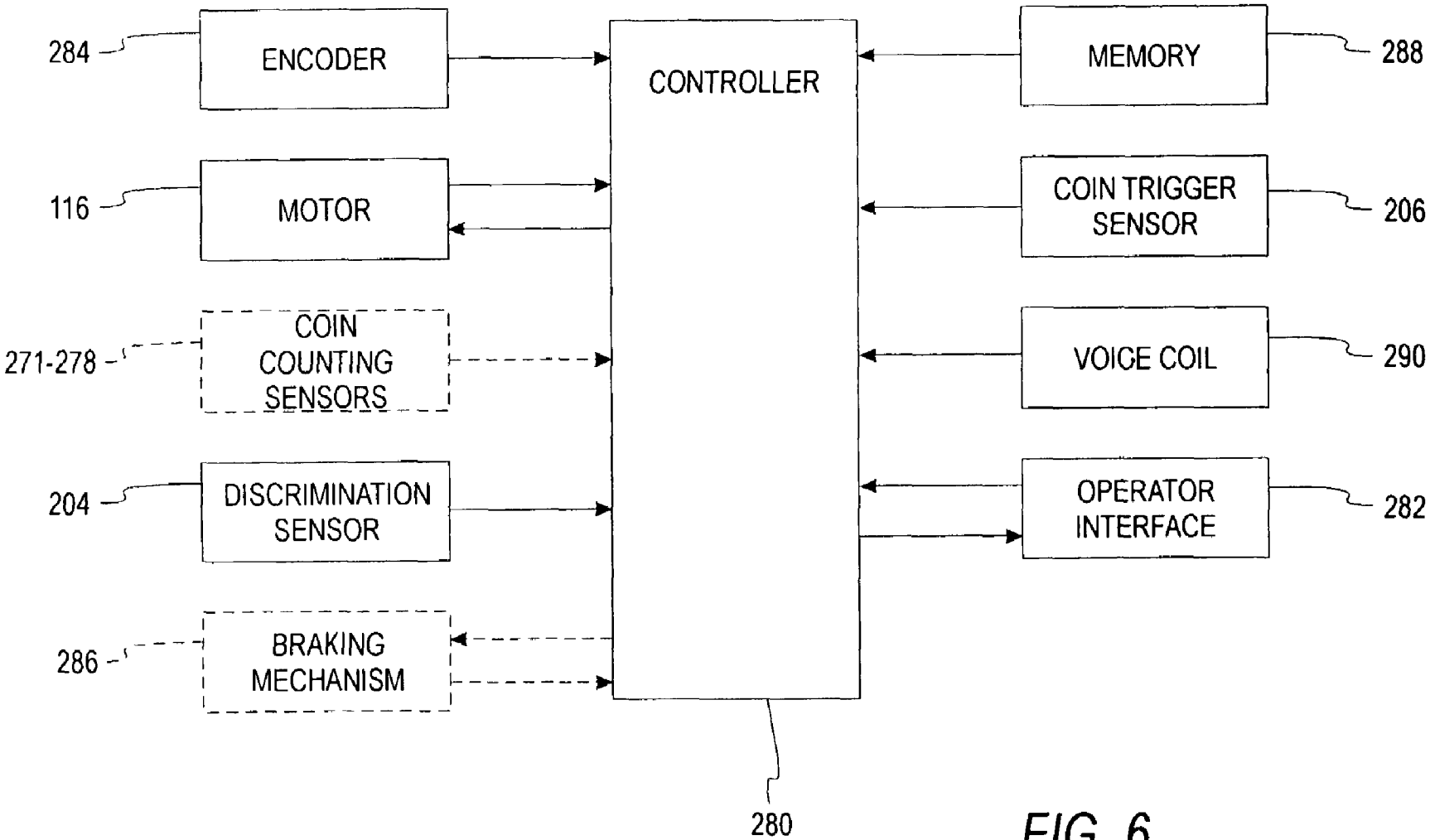
FIG. 6 is a functional block diagram of the control system for the coin processing system shown in FIG. 1.

FIG. 6 illustrates a system controller 280 and its relationship to the other components in the coin processing system 100. The operator communicates with the coin processing system 100 via an operator interface 282 for receiving information from an operator and displaying information to the operator about the functions and operation of the coin processing system 100. The controller 280 monitors the angular position of the disc 114 via an encoder 284 which sends an encoder count to the controller 280 upon each incremental movement of the disc 114. Based on input from the encoder 284, the controller 280 determines the angular velocity at which the disc 114 is rotating as well as the change in angular velocity, that is the acceleration and deceleration, of the disc 114. The encoder 284 allows the controller 280 to track the position of coins on the sorting head 112 after being sensed. According to one embodiment of the coin processing system 100, the encoder has a resolution of 2000 pulses per revolution of the disc 114.

Furthermore, the encoder 284 can be of a type commonly known as a dual channel encoder that utilizes two encoder sensors (not shown). The signals that are produced by the two encoder sensors and detected by the controller 280 are generally out of phase. The direction of movement of the disc 114 can be monitored by utilizing the dual channel encoder.

The controller 280 also controls the power supplied to the motor 116 which drives the rotatable disc 114. When the motor 116 is a DC motor, the controller 280 can reverse the current to the motor 116 to cause the rotatable disc 114 to decelerate. Thus, the controller 270 can control the speed of the rotatable disc 114 without the need for a braking mechanism.

If a braking mechanism 280 is used, the controller 280 also controls the braking mechanism 286. Because the amount of power applied is proportional to the braking force, the controller 280 has the ability to alter the deceleration of the disc 114 by varying the power applied to the braking mechanism 286.

According to one embodiment of the coin processing 100, the controller 280 also monitors the coin counting sensors 271-278 which are disposed in each of the coin exit channels 261-268 of the sorting head 112 (or just outside the periphery of the sorting head 112). As coins move past one of these counting sensors 271-278, the controller 280 receives a signal from the counting sensor 271-278 for the particular denomination of the passing coin and adds one to the counter for that particular denomination within the controller 280. The controller 280 maintains a counter for each denomination of coin that is to be sorted. In this way, each denomination of coin being sorted by the coin processing system 100 has a count continuously tallied and updated by the controller 280. The controller 280 is able to cause the rotatable disc 114 to quickly terminate rotation after a "n" number (i.e., a predetermined number) of coins have been discharged from an output receptacle, but before the "n+1" coin has been discharged. For example, it may be necessary to stop the discharging of coins after a predetermined number of coins have been delivered to a coin receptacle, such as a coin bag, so that each bag contains a known amount of coins, or to prevent a coin receptacle from becoming overfilled. Alternatively, the controller 280 can cause the system to switch between bags in embodiments having more than one coin bag corresponding to each output receptacle.

In one embodiment, the controller 280 also monitors the output of coin discrimination sensor 204 and compares information received from the discrimination sensor 204 to master information stored in a memory 288 of the coin processing system 100 including information obtained from known genuine coins. If the received information does not favorably compare to master information stored in the memory 288, the controller 280 sends a signal to the voice coil 290 causing the diverting pin 210 to move to the diverting position.

According to one embodiment of the coin processing system 100, after a coin moves past the trigger sensor 206, the coin discrimination sensor 204 begins sampling the coin. The discrimination sensor 204 begins sampling the coins within about 30 microseconds ("μs") of a coin clearing the trigger sensor 206. The sampling ends after the coin clears a portion or all of the discrimination sensor 204. A coin's signature, which consists of the samples of the coin obtained by the discrimination sensor 204, is sent to the controller 280 after the coin clears the trigger sensor 206 or, alternatively, after the coin clears the discrimination sensor 204. As an example, when the coin processing system 100 operates as a speed of 350 r.p.m. and the sorting head 112 has a diameter of eleven inches, it takes approximately 3900 μs for a 1¢ Euro coin (having a diameter of about 0.640 inch) to clear the trigger sensor 206. A larger coin would take more time.

The controller 280 then compares the coin's signature to a library of "master" signatures obtained from known genuine coins stored in the memory 288. The time required for the controller 280 to determine whether a coin is invalid is dependent on the number of master signatures stored in the memory 288 of the coin processing system 100. According to one embodiment of the present invention, there are thirty-two master signatures stored in the memory 288, while other embodiments may include any practical number of master signatures. Generally, regardless of the number of stored signatures, the controller 280 determines whether to reject a coin in less than 250 μs.

After determining that a coin is invalid, the controller 280 sends a signal to activate the voice coil 290 for moving the diverting pin 210 to the diverting position. As shown in FIG. 2, the diverting pin 210 is located about 1.8 inches downstream from the trigger sensor 206 on the eleven inch sorting head. Assuming an operating speed of 350 r.p.m., for example, the controller 280 activates the voice coil 290 within about 7300 μs from the time that the coin crosses the trigger sensor 206. As discussed above, the voice coil 290 is capable of moving the diverting pin 210 approximately an ⅛ inch in about 1300 μs.

Therefore, assuming an eleven inch sorting disk, an operational speed of 350 r.p.m. and a trigger sensor 206, discrimination sensor 204 and a diverting pin 210 arrangement as shown in FIG. 2, about 11000 μs (11 milliseconds) elapses from the time a coin crosses the trigger sensor 206 until the diverting pin 210 is lowered to the diverting position. Thus, the diverting pin 210 is located less than about two inches downstream of the trigger sensor 206. Accordingly, the spacing between coins crossing the trigger sensor 206 is less than about two inches.

Once the diverting pin 210 is moved to the diverting position, the diverting pin 210 remains in the diverting position until a valid coin is encountered by the discrimination sensor 204 according to one embodiment of the present invention. This reduces wear and tear on the voice coil 190. For example, the diverting pin 210 will only be moved to the diverting position one time when three invalid coins in a row are detected, for example, in applications involving a heavy mix of valid and invalid coins. If the fourth coin is determined to be a valid coin, the diverting pin 210 is moved to its home position. Further, according to some embodiments of the coin processing system 100, the diverting pin 210 is moved to the home position if the trigger sensor 206 sensor does not detect a coin within about two seconds of the last coin that was detected by the trigger sensor 206, which can occur when a batch of coins being processed in nearing the end of the batch. This reduces wear and tear on the pad 118, which is rotating beneath the diverting pin 210*b*, because the diverting pin 210 and the rotating pad 118 are in contact when the diverting pin 210 is in the diverting position.

Because of the spacing imparted to the coins via the L-shaped queuing channel 166, it is not necessary to slow or stop the machine to off-sort the invalid coins. Rather, the combination of the increased spacing and fast-activating voice coil 290 contribute to the ability of the coin sorter system illustrated in FIGS. 1 and 2 to be able to discriminate coins on the fly.

The superior performance of coin processing systems according to one embodiment of the present invention is illustrated by the following example. Prior art coin sorters, such as those discussed in the Background Section where is was necessary to stop and then jog the disc to remove an invalid coin, that utilized an eleven inch sorting disc were capable of sorting a retail mix of coins at a rate of about 3000 coins per minute when operating at a speed for about 250 r.p.m. (A common retail mix of coins is about 30% dimes, 28% pennies, 16% nickels, 15% quarters, 7% half-dollar coins, and 4% dollar coins.) The ability to further increase the operating speed of these prior art devices is limited by the need to be able to quickly stop the rotation of the disc before the invalid coin is discharged as is discussed in the Background Section. According to one embodiment of the coin processing system 100 of FIGS. 1 and 2, the system 100 is cable of sorting a retail mix of coins at a rate of about 3300 coins per minute when the sorting head 112 has a diameter of eleven inches and the disc is rotated at about 300 r.p.m. According to another embodiment of the present invention, the coin processing system 100 is capable of sorting a "Euro financial mix" of coins at rate of about 3400 coins per minute, wherein the sorting head 112 has a diameter of eleven inches and the disc is rotated at about 350 r.p.m. (A common Euro financial mix of coins made up of about 41.1% 2 Euro coins, about 16.7% 1 Euro coins, about 14.3% 50¢ Euro coins, about 13.0% 20¢ Euro coins, about 11.0% 10¢ Euro coins, about 12.1% 5¢ coins and about 8.5% 1¢ Euro coins.)

In one embodiment of the coin processing system 100, the coin discrimination sensor 210 determines the denomination of each of the coins as well as discriminates between valid and invalid coins, and does not include coin counting sensors 271-278. In this embodiment, as coins move past the discrimination sensor 204, the controller 280 receives a signal from discrimination sensor 204. When the received information favorably compares to the master information, a one is added to a counter for that particular determined denomination within the controller 280. The controller 280 has a counter for each denomination of coin that is to be sorted. As each coin is moved past the discrimination sensor 204, the controller 280 is now aware of the location of the coin and is able to track the angular movement of that coin as the controller receives encoder counts from the encoder 284. Therefore, referring back to the previous coin bag example, the controller 280 is able to determined at the precise moment at which to stop the rotating disc 114 such that the "nth" coin is discharged from a particular output channel 261-286, but the "n+1" coin is not. For example, in an application requiring one thousand dimes per coin bag, the controller counts number of dimes sensed by the discrimination sensor 204 and the precise number of encoder counts at which it should halt the rotation of the disc 114—when the 1000th dime is discharged from the coin exit channel, but not the 1001st dime.

Additional embodiments of a coin processing system into which the discrimination sensor of the present invention may be employed are disclosed in commonly assigned U.S. Pat. No. 6,755,730, entitled "Disc-Type Coin Processing Device Having Improved Coin Discrimination System," which issued on Jun. 29, 2004, and is herein incorporated by reference in its entirety.

Figure 7:
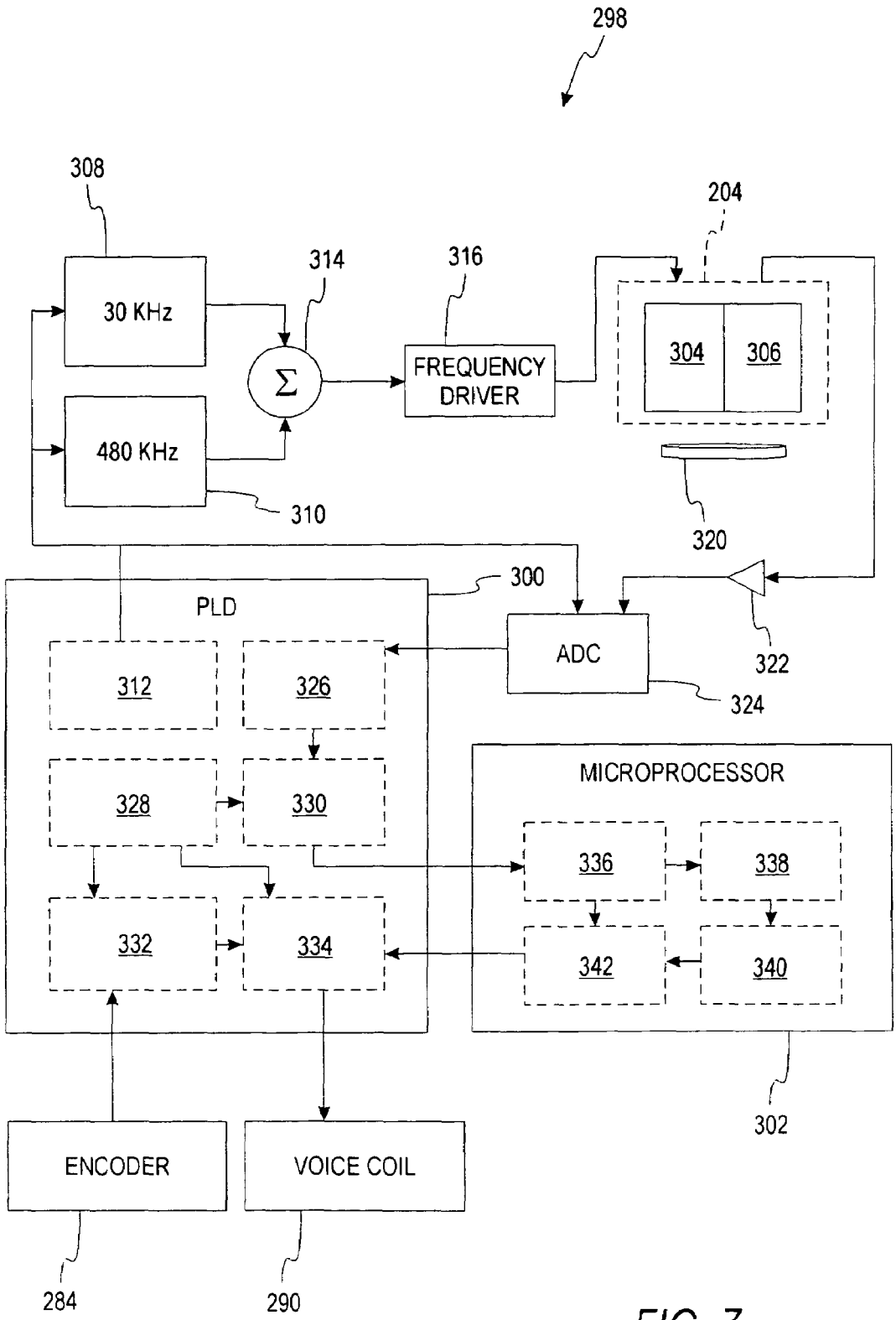
FIG. 7 is a functional block diagram of a coin discrimination system according to an embodiment of the present invention.

FIG. 7 is functional block diagrams illustrative of a coin discrimination system 298 according to one embodiment of the present invention. The system generally includes the coin discrimination sensor 204, a programmable logic device (PLD) 300, and a microprocessor 302. In alternate embodiments, the controller 280 may include the PLD 300 and/or the microprocessor 302. The coin discrimination sensor 204 generally includes an excitation coil 304 and detector coils 306. The excitation coil 304 is excited with a 480 KHz source wave that is added to a 30 KHz source wave. The 30 KHz source wave is generated by a 30 KHz Direct Digital Synthesis (DDS) sine wave generator 308, and the 480 KHz source wave is generated by a 480 KHz DDS sine wave generator 310. In a specific embodiment, the DDS sine wave generators are Analog Devices AD9850 devices, though it is understood that any suitable waveform generators may be employed.

A DDS programming logic and clock generator 312 in the PLD 300 allows the 30 KHz and 480 KHz sine waves to stay synchronized with the PLD 300, and allows the PLD to track the position of each waveform as it rolls from 0 to 360 degrees. The 30 KHz and 480 KHz sine waves are combined in a combiner 314, which may also buffer and amplify the resulting signal. The resulting signal is driven by a high frequency driver 316 into the excitation coil 304 of the coil discrimination sensor 204 as an excitation signal. In one embodiment, the high frequency driver 316 is a 1 Amp high current, high frequency driver and the excitation signal is 10 volts peak-to-peak (plus or minus 5 volts).

Although the DDS sine wave generators 308, 310 output a 30 KHz and 480 KHz signal, respectively, other combinations of frequencies may be employed. As is known, low frequencies tend to penetrate further into a coin, whereas high frequencies penetrate only the surface of the coin. The particular selection of frequencies may be influenced by the metal contents and thicknesses of the set of coins to be analyzed, for example. Whether the coins have claddings may be another factor that influences the selection of frequencies. It is understood that the present invention is not limited to the frequencies of 30 KHz and 480 KHz, but rather is intended to encompass any combination of frequencies suitable for discriminating coins of a particular set. For example, one set may include U.S. coins, another set may include tokens, another set may include a combination of U.S. and Euro coins, and so forth.

When a coin 320 approaches the coin discrimination sensor 204, its presence will be first detected by the coin trigger sensor 206, which signals the system 298 to begin monitoring the coin discrimination sensor 204 for the coin 320. The PLD 300 is also instructed to capture the current location of the coin with reference to the encoder 284. The PLD 300 calculates how many pulses of the encoder 284 to wait until the coin 320 will approach the voice coil 290. The projected position of the encoder 284 is stored in a FIFO memory (not shown) within the PLD 300, until the coin 320 can be processed and a decision whether to accept or reject the coin 320 has been made by the microprocessor 302.

As explained in more detail with reference to FIGS. 10-12, the detector coils 306 should be balanced to receive the same level of induced voltage from the excitation coil 304 so as to cancel out the currents from the locally generated magnetic field, resulting in 0 VDC difference between the induced voltages in each of the detector coils 306. As a coin 320 passes by the coin discrimination sensor 306, eddy currents in the coin 320 induce different voltages in each of the detector coils 306. The difference between these voltages results in a detection signal which is indicative of the amplitude and phase differences with respect to the excitation signal. In one embodiment, the detection signal is 1 volt peak-to-peak.

The detection signal is buffered and amplified in a buffer 322 and is scaled to, for example, 5 volts peak-to-peak (0 to 5 volts), and is then processed in a high-speed analog-to-digital converter (ADC) 324. In a specific embodiment, the ADC 324 is clocked at 7.68 MHz and generates a 12-bit number with each rising clock edge. The ADC 324 thus produces 256 samples of the detection signal for each full cycle of the 30 KHz source wave. Next, the output of the ADC 324 is presented to the PLD 300, which includes a Fast Fourier Transform (FFT) Logic 326, System Diagnostics and Mode Control Logic 328, Peak Detector Logic 330, Quadrature Decoder and Coin Position Tracking Logic 332, and Voice Coil Control Logic 334. The FFT Logic 326 of the PLD 300 separates the 480 KHz and 30 KHz components of the detection signal, and provides the instantaneous amplitudes of the 30 KHz component of the detection signal at the 0 degree (sine) and 90 degree (cosine) positions of the 30 KHz component of the source wave, and the instantaneous amplitudes of the 480 KHz component of the detection signal at the sine and cosine positions of the 480 KHz component of the source wave.

It will be appreciated that the phase angles 0 degrees and 90 degrees are merely illustrative of numerous possible combinations of phase angles. For example, in one embodiment, the phase angles could be 45 degrees and 135 degrees. Preferably, the phase angles are selected to be about 90 degrees apart, however other phase angle differences may be employed.

The source wave is used as a phase reference for the calculations, so therefore, the difference, or phase shift, can be represented as coin signature values. Because the FFT Logic 326 completes its calculations with each set of the 256 samples of the ADC 324, the FFT Logic 326 can generate 30,000 coin signatures per second. Each coin signature is comprised of the Sine 30 KHz Amplitude, the Cosine 30 KHz Amplitude, the Sine 480 KHz Amplitude, and the Cosine 480 KHz Amplitude.

The PLD 300 monitors the 30,000 signatures per second, and the Peak Detector Logic 330 component of the PLD 300 stores the one signature that represents the largest amplitude of the 480 KHz component of the detection signal. This is the point in which the greatest amount of surface area of the coin is proximate the coin discrimination sensor 204, i.e., the coin is generally centered relative to the discrimination sensor 204. For a particular coin set, each coin should present a unique coin signature so long as each coin in the coin set has unique combinations of metal content, thickness, and diameter. For example, even if two coins have the same metal content and diameter, their difference in thickness may be sufficient to present uniquely discernible coin signatures.

The coin signature stored by the Peak Detector Logic 330 in the PLD 300 is processed by the microprocessor 302. In a specific embodiment, the microprocessor 302 generally includes the following components: a Signature Calibration Control 336, a Coin Signature Training System 338, a Coin Data Table 340, and a Coin Identification System 342. Instructions and/or logic that comprise the Signature Calibration Control 336 may adjust the coin signature to compensate for calibration offsets and/or temperature drifts. The adjusted coin signature is compared against the Coin Data Table 340, which, according to one embodiment, contains a window of acceptable coin signature values for a given coin. If the adjusted coin signature falls within that window, the Coin Identification System 342 instructs the PLD 300 to allow the coin to pass by the voice coil 290. If the microprocessor 302 cannot find a window into which the current coin falls, then the microprocessor 302 instructs the PLD 300 to cause the voice coil 290 to reject the coin. A more detailed description of the coin signature values is provided below.

In another embodiment, the Coin Data Table 340 includes a plurality of mathematical formulae, where each formula corresponds to a curve. For example, if the voltages generated by the eddy currents in a coin passing by the coin discrimination sensor 204 are plotted against the position of the coin, the plot will resemble a curve which can be represented mathematically. This mathematical formula can be stored in the Coin Data Table 340, and when a passing coin's position and voltage data can be supplied to the formula to determine if this particular coin falls on the curve (within a certain tolerance, if desired).

As mentioned above, the PLD 300 monitors the position of the coin via the encoder 284. When the position of the coin from the encoder 284 matches the projected location stored in the FIFO memory of the PLD 300, the PLD 300 commands the Voice Code Control Logic 334 to move the pin of the voice coil 290 in a direction which depends on whether a valid coin was detected. For example, if a valid coin is detected, the voice coil 290 may be retracted to allow the coin to pass by the voice coil 290. If an invalid coin is detected, it may be flagged by the microprocessor 302, and the voice coil 290 may be extended to divert the coin out of the sorting head 112 and into a reject bin. Note that as a coin is moved toward the voice coil 290, the system 298 can process one or more additional coins, and the FIFO memory of the PLD 300 can keep track of each coin, where it is located relative to the sorting head 112, and flag a particular coin according to a desired characteristic, such a whether the coin is a valid or invalid coin. In this manner, the voice coil 290 can be located a distance away from the coin discrimination sensor 204.

The Coin Signature Training System 338 aspect of the microprocessor 302 may be used to place the system 298 into a learning mode to develop signature windows for coins and/or to expand the library of recognized coins stored in the Coin Data Table 340. For example, a new coin set may be desired to be sorted, such as the British coin set. In the learning mode, several to hundreds of British coins are processed by the system 298, and the microprocessor 302 develops signature windows for each denomination of coin and stores each window in the Coin Data Table 340. If a new token (which, as used herein, is a type of coin) is added to an existing token set, the new tokens can be processed by the system 298 in the learning mode, and a new signature window is developed and stored in the Coin Data Table 340.

Figure 8:
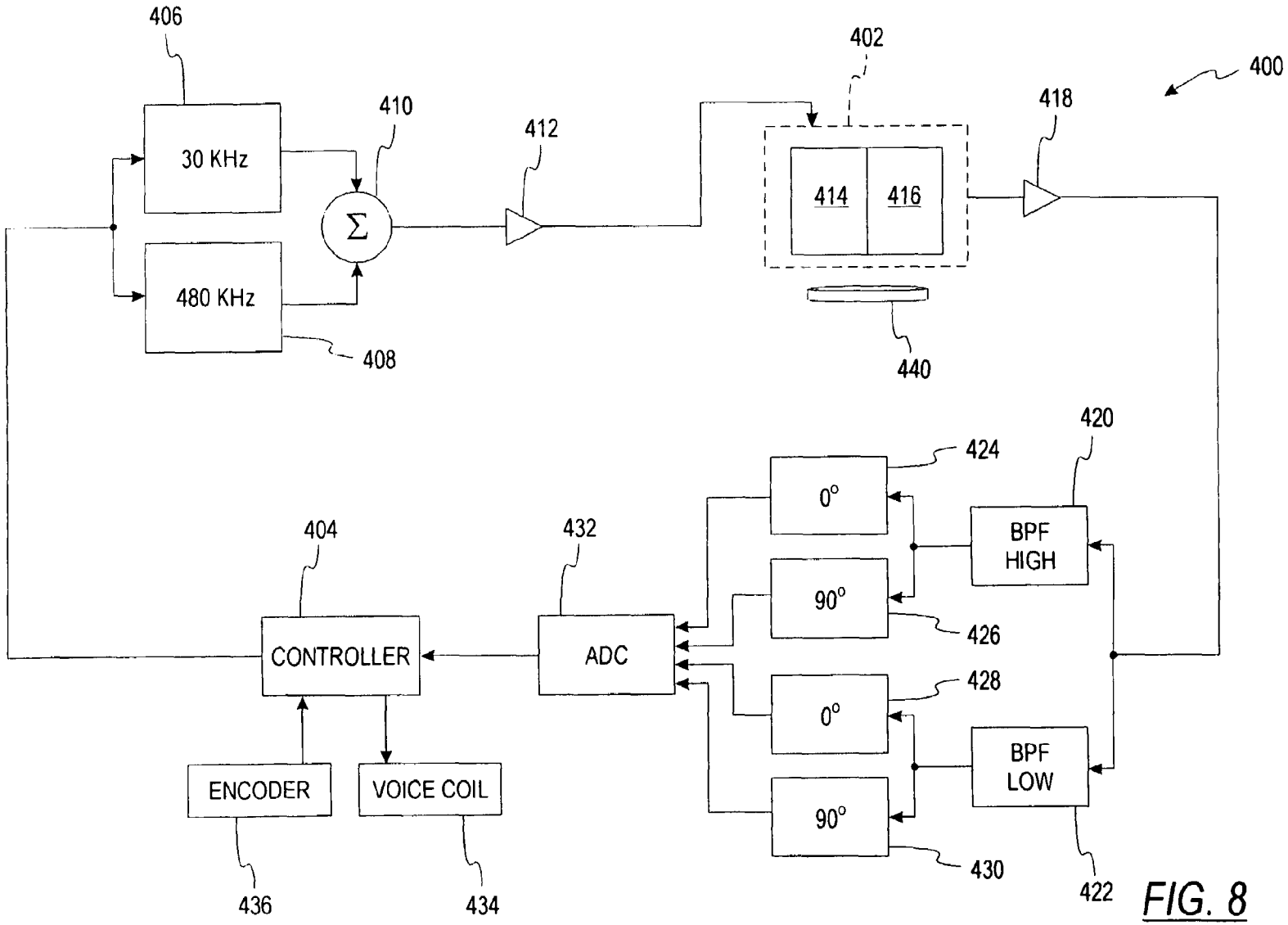
FIG. 8 is a functional block diagram of a coin discrimination system according to another embodiment of the present invention.

It will be appreciated that the blocks shown in the PLD 300 and the microprocessor 302 shown in FIG. 8 are functional and are not intended to represent all of the functional aspects to the PLD 300 or the microprocessor 302. In addition, various of the blocks may be eliminated, such as, for example, the Coin Signature Training System 338 in the microprocessor 302, without departing from the present invention. Moreover, some blocks which are shown as a functional aspect of the PLD 300 may instead be a functional aspect of the microprocessor 302. For example, the Voice Coil Control Logic 334 in the PLD 300 may instead be a functional aspect of the microprocessor 302. Similarly, one or both of the encoder 284 and the voice coil 290 may be coupled to the microprocessor 302 in alternate embodiments. Finally, as mentioned above, the controller 280 shown in FIG. 6 is a general functional representation of the processing and logic circuitry of the system 298 and may include one or both of the PLD 300 and the microprocessor 302.

FIG. 8 shows a functional block diagram of a coin discrimination system 400 according to an embodiment of the present invention that lacks the PLD 300 shown in FIG. 7. The system 400 generally includes a coin discrimination sensor 402 which is coupled to a controller 404. A 30 KHz sine wave generator 406 and a 480 KHz sine wave generator 408 produce a 30 KHz source wave and a 480 KHz source wave, respectively, which are added together in a combiner 410, amplified and buffered in a buffer 412, and driven into an excitation coil 414 of the coin discrimination sensor 402. The coin discrimination sensor 402 also includes detector coils 416 which detect the eddy currents in a coin 440 passing proximate the coin discrimination sensor 402. The detection signal is buffered and amplified in a buffer 418. The resulting detection signal is presented to a high bandpass filter 420 and a low bandpass filter 422, which isolate the 480 KHz and 30 KHz frequency components, respectively, of the detection signal. Thus, the signal from the high bandpass filter 420 includes amplitude and phase information of the 480 KHz component of the detection signal, and the signal from the low bandpass filter 422 includes amplitude and phase information of the 30 KHz component of the detection signal.

The signal from the high bandpass filter 420 is presented to a 0° sample and hold circuit 424 and a 90° sample and hold circuit 426, which provide the amplitudes of the 480 KHz component of the detection signal at two phase points that are 90° apart. Similarly, the signal from the low bandpass filter 422 is presented to a 0° sample and hold circuit 428 and a 90° sample and hold circuit 430, which provide the amplitudes of the 30 KHz component of the detection signal at two phase points that are 90° apart. The voltage outputs of the sample and hold circuits 424, 426, 428, 430 are presented to an ADC 432, which samples the outputs to provide digital values of the amplitudes to the controller 404. As mentioned before, the controller 404 uses the data from an encoder 436 to communicate instructions to a voice coil 434 based on the values from the ADC 432 and the coin signature tables stored in memory.

Figure 9A:
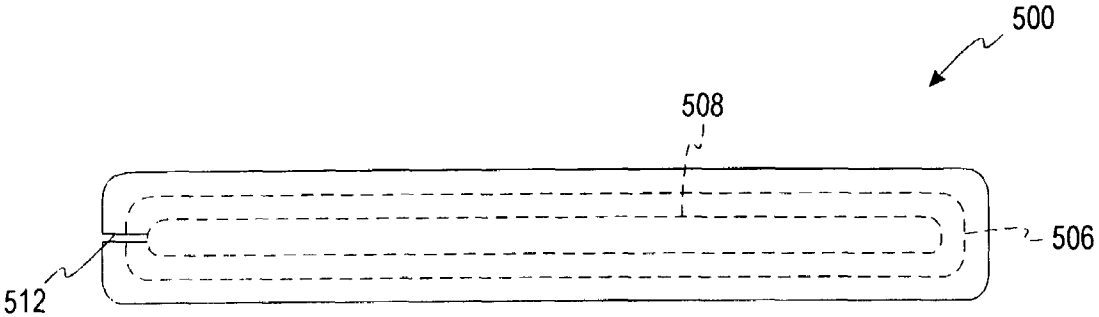
FIG. 9*a* is a top view of a bobbin which is employed in a coin discrimination sensor according to the present invention.
Figure 9B:
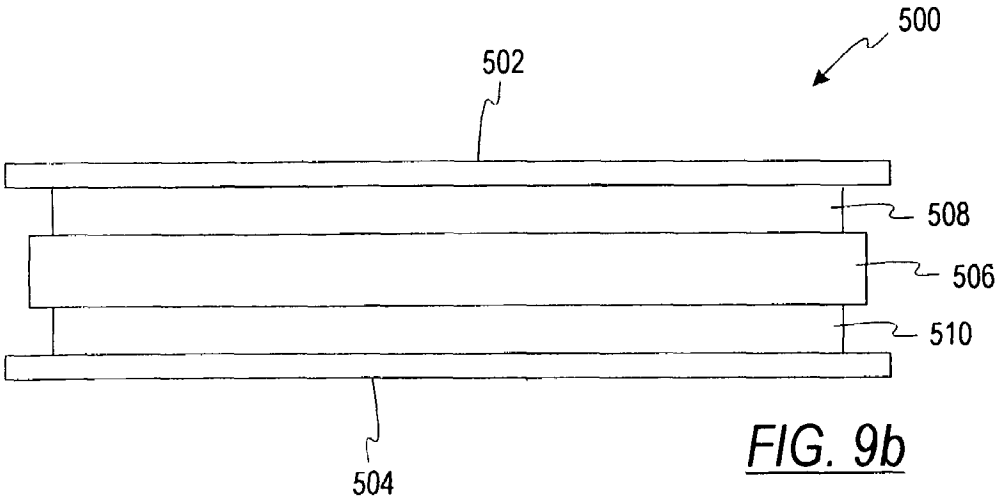
FIG. 9*b* is a side view of the bobbin shown in FIG. 9*a;*
Figure 9C:
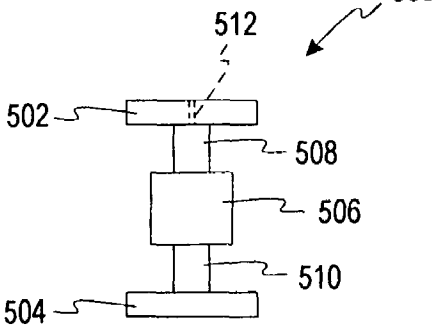
FIG. 9*c* is an end view of the bobbin shown in FIG. 9*b;*

FIGS. 9*a* to 9*c* illustrate top, side, and end views, respectively, of a coil bobbin 500 for use in a coin discrimination sensor according to one embodiment of the present invention. The coil bobbin 500 includes a top retaining layer 502, a bottom retaining layer 504, a projection 506, a first wire recess 508, and a second wire recess 510. An aperture 512 is formed in the top retaining layer 502 to accept therethrough wire ends from wires wound around the bobbin 500. In a specific embodiment, the bobbin 500 is made of Delrin, however in other embodiments the bobbin 500 may be made of any other suitable material such as Nylon, ceramic, alumina, or any other non-metallic material.

In a specific embodiment, the top retaining layer 502 has approximate dimensions of 1.5 inches×0.22 inches×0.04 inches (length×width×height). The first wire recess 508 and the second wire recess 510 have approximate dimensions of 1.34 inches×0.06 inches×0.08 inches (length×width×height). The projection 506 has approximate dimensions of 1.42 inches×0.14 inches×0.12 inches (length×width×height). The aperture 512 is approximately 0.01 inches wide. The overall dimensions of the bobbin 500 are approximately 1.5 inches×0.22 inches×0.36 inches (length×width×height). The bobbin 500 is positioned a distance away from a passing coin such that the thickest coin to be processed can move past the bobbin 500 without causing undesired frictional contact with the surface of the bobbin 500 proximate to the passing coin.

Figure 10:
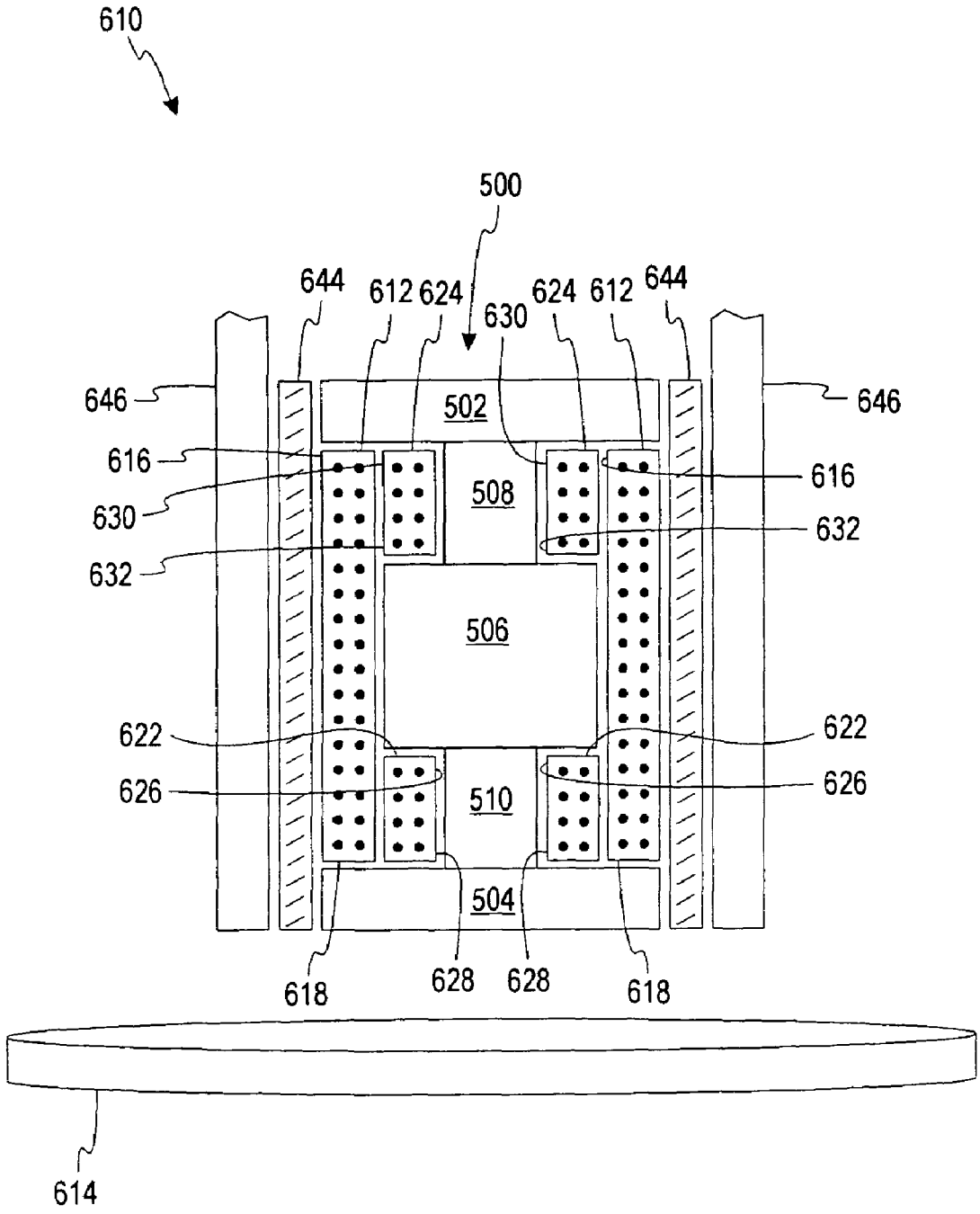
FIG. 10 is a diagrammatic cross-sectional view of a coin discrimination sensor according to an embodiment of the present invention.
Figure 11:
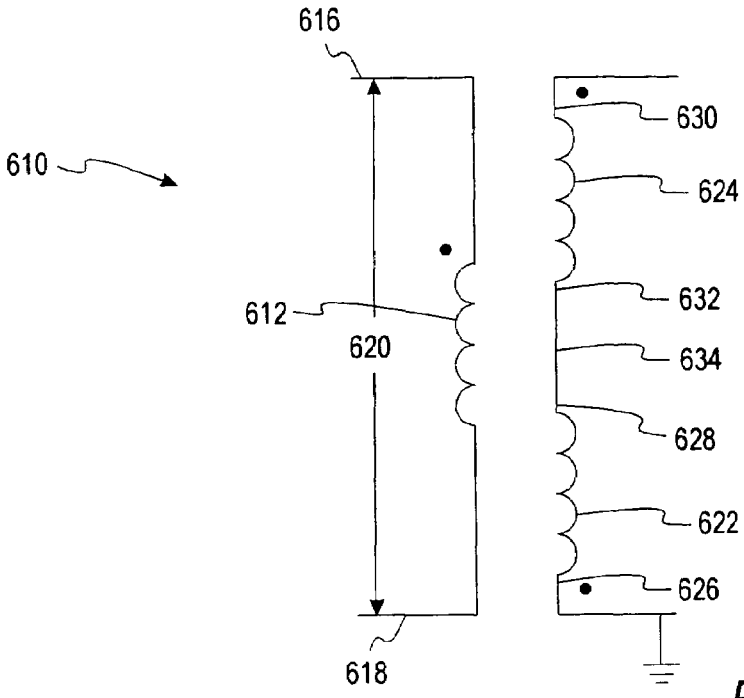
FIG. 11 is a schematic circuit diagram of the coin discrimination sensor of FIG. 10.
Figure 12:
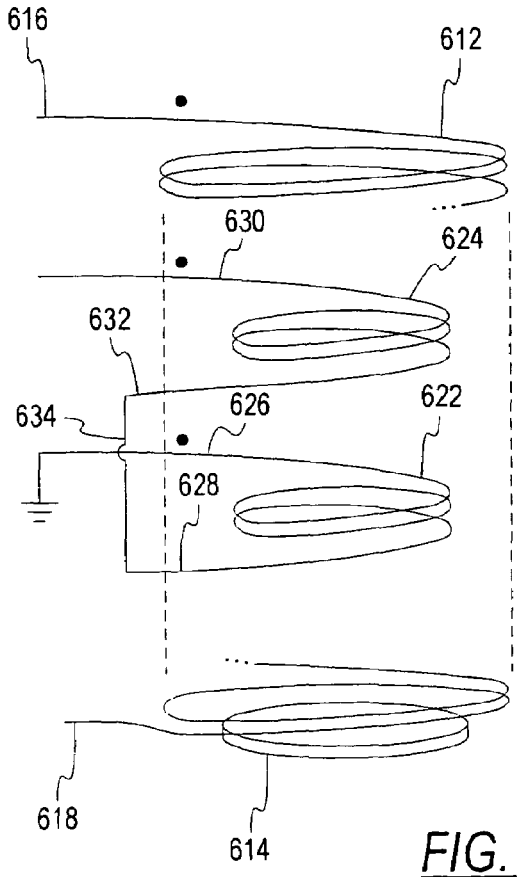
FIG. 12 is a diagrammatic perspective view of the coils in the coin discrimination sensor of FIG. 10.

Turning to FIGS. 10-12, one embodiment of the present invention employs a coin discrimination sensor 610, which may be employed in the embodiments described with reference to FIGS. 7 and 8. The coin discrimination sensor 610 includes an excitation coil 612 for generating alternating magnetic fields that induce eddy currents in a coin 614. The excitation coil 612 has a start end 616 and a finish end 618. In one embodiment, an excitation coil voltage, e.g., a signal having 30 KHz and 480 KHz frequency components and 10 volts peak-to-peak, is applied across the start end 616 and the finish end 618 of the excitation coil 612. The excitation voltage produces a corresponding current in the excitation coil 612 which in turn produces corresponding alternating magnetic fields. The alternating magnetic fields exist within and around the excitation coil 612 and extend outwardly to the coin 614. The magnetic fields penetrate the coin 614 as the coin 614 is moved proximate to the excitation coil 612, and eddy currents are induced in the coin 614 as it moves through the alternating magnetic fields. The strength of the eddy currents flowing in the coin 614 is dependent on the material composition of the coin, and particularly the electrical resistance of that material. Resistance affects how much current will flow in the coin 614 according to Ohm's Law. Another characteristic by which the material composition of a coin is measured is conductivity according to the IACS scale, for example, which defines copper has having a conductivity of 100%.

The eddy currents themselves also produce corresponding magnetic fields. A proximal detector coil 622 and a distal detector coil 624 are disposed relative to the coin 614 so that the eddy current-generated magnetic fields induce voltages upon the coils 622, 624. The distal detector coil 624 is positioned above the coin 614, and the proximal detector coil 622 is positioned between the distal detector coil 624 and the passing coin 614.

In one embodiment, the excitation coil 612, the proximal detector coil 622 and the distal detector coil 624 are all wound in the same direction (either clockwise or counterclockwise). The proximal detector coil 622 and the distal detector coil 624 are wound in the same direction so that the voltages induced on these coils by the eddy currents are properly oriented. As shown in FIG. 10, the proximal detector coil 622 is wound around the second wire recess 510 of the bobbin 500 and is bounded by the bottom retaining layer 504 and the projection 506. The distal detector coil 624 is wound around the first wire recess 508 of the bobbin 500 and is bounded by the top retaining layer 502 and the projection 506. Finally, the excitation coil 612 is wound around the proximal detector coil 622, the distal detector coil 624, and the projection 506, and is bounded by the top retaining layer 502 and the bottom retaining layer 504.

The length dimension of the proximal detector coil 622 once wound around the bobbin 500 is substantially equal to the length dimension of the distal detector coil 624 once wound around the bobbin 500, which dimensions substantially correspond to the length of the projection 506 of the bobbin 500. In one embodiment, the length dimensions of the proximal and distal detector coils 622, 624 are longer than the diameter of the largest coin to be processed. Because the magnetic fields radiate slightly beyond the length dimensions of the coils 622, 624, in another embodiment, the length dimensions of the coils 622, 624 are about the same as the diameter of the largest coin to be processed. In both embodiments, passing coins of varying diameters create unique disruptions in the magnetic fields so as to induce distinctive eddy currents in each coin depending on its diameter.

An exploded diagrammatic perspective view of the coils 612, 622, 624 of the coil discrimination sensor 610 is shown in FIG. 12. Note that the number of windings and the shape of the coils 612, 622, 624 are not shown to scale for ease of illustration.

The proximal detector coil 622 has a starting end 626 and a finish end 628. Similarly, the distal detector coil 624 has a starting end 630 and a finish end 632. In order of increasing distance from the coin 614, the detector coils 622, 624 are positioned as follows: finish end 628 of the proximal detector coil 622, start end 626 of the proximal detector coil 622, finish end 632 of the distal detector coil 624 and start end 630 of the distal detector coil 624. As shown in FIGS. 11 and 12, the finish end 628 of the proximal detector coil 622 is connected to the finish end 632 of the distal detector coil 624 via a conductive wire 634. It will be appreciated by those skilled in the art that other detector coil 622, 624 combinations are possible. For example, in an alternative embodiment the proximal detector coil 622 is wound in the opposite direction of the distal detector coil 624. In such an embodiment, the start end 626 of the proximal coil 622 would be connected to the finish end 632 of the distal coil 624.

Eddy currents in the coin 614 induce voltages $V_{prox}$ and $V_{dist}$ respectively on the detector coils 622, 624. Likewise, the excitation coil 612 also induces a common-mode voltage on each of the detector coils 622, 624. The common-mode voltage is effectively the same on each detector coil due to the symmetry of the detector coils' physical arrangement within the excitation coil 612. Because the detector coils 622, 624 are wound and physically oriented in the same direction and connected at their finish ends 628, 632, the common-mode voltage induced by the excitation coil 612 is subtracted out, leaving only a difference voltage $V_{diff}$ corresponding to the eddy currents in the coin 614. Thus, the need for additional circuitry to subtract out the common-mode voltage is eliminated. The common-mode voltage is effectively subtracted out because both the distal detector coil 624 and the proximal detector coil 622 receive the same level of induced voltage from the excitation coil 612.

Unlike the common-mode voltage, the voltages induced by the eddy current in the detector coils 622, 624 are not effectively the same because the proximal detector coil 622 is positioned closer to the passing coin than the distal detector coil 624. Thus, the voltage induced in the proximal detector coil 622 is significantly stronger, i.e. has greater amplitude, than the voltage induced in the distal detector coil 624. Although the present invention subtracts the eddy current-induced voltage on the distal coil 624 from the eddy current-induced voltage on the proximal coil 622, the voltage amplitude difference is sufficiently great to permit detailed resolution of the eddy current response.

As shown in FIG. 10, the excitation coil 612 is surrounded by a magnetic shield 644. The magnetic shield 644 has a high level of magnetic permeability in order to help contain the magnetic fields surrounding the excitation coil 612. The magnetic shield 644 advantageously prevents stray magnetic fields from interfering with other nearby eddy current sensors. The magnetic shield 644 is not a closed cylinder and has a small longitudinal air gap so that it does not act as a shorter turn of conducting material that absorbs the electrical energy and prevents it from forming a useful magnetic field. The magnetic shield 644 is itself optionally surrounded by an outer case 646 made of, for example, steel. Optionally, the magnetic shield 644 and/or the outer case 646 may be extended to surround the bottom retaining layer 504 and/or the top retaining layer 502 of the bobbin 500.

To form the coin discrimination sensor 610, the detector coils 622, 624 are wound on the bobbin 500. Both the proximal detector coil 622 and the distal detector coil 624 have 350 turns of #44 AWG enamel-covered magnet wire wound to generally uniformly fill the available spaces as described above. Each of the detector coils 622, 624 are wound in the same direction with the finish ends 628, 632 and are connected together by the conductive wire 634. The start ends 626, 630 of the detector coils 622, 624 are connected to separately identified wires in a connecting cable. The excitation coil 612 is wound with 135 turns of #42 AWG enamel-covered magnet wire in the same direction as the detector coils 622, 624. An excitation coil voltage 620 is applied across the start end 616 and the finish end 618.

In one embodiment, the coin discrimination sensor 610 is calibrated such that common-mode voltage is subtracted out when no coin is present (hereafter referred to as the "nominal" condition). The coin discrimination sensor 610 is connected to a test oscillator (not shown) which applies the excitation voltage to the excitation coil 612. The position of the excitation coil 612 is adjusted along the axis of the coil to give a null response from the detector coils 622, 624 on an a-c. voltmeter with no metal near the coil windings. Optionally, the magnetic shield 644 is positioned over the excitation coil 612 and the position of the excitation coil 612 is again adjusted to give a null response from the detector coils 622, 624.

The magnetic shield 644 and coils 612, 622, 624 within the magnetic shield 644 are optionally placed in the outer case 646 and encapsulated with a polymer resin (not shown) to "freeze" the position of the magnetic shield 644 and coils 612, 622, 624.

After curing the resin, an end of the coin discrimination sensor 610 nearest the proximal detector coil 622 is sanded and lapped to produce a flat and smooth surface with the coils 612, 622 slightly recessed within the resin.

The voltage 620 applied to the excitation coil 612 causes current to flow in the coil 612 which lags behind the voltage 620. For example, the current may lag the voltage 620 by about 90 degrees. In effect, the eddy currents of the coin 614 impose a resistive loss on the current in the excitation coil 612. Because the voltage 620 has two frequency components, e.g., a 30 KHz component and a 480 KHz component in one embodiment, each frequency component will have a phase and amplitude characteristic associated therewith, resulting in four parameters associated with a detection signal from the detector coils 622, 624, i.e., the phase and amplitude of the 30 KHz component and the phase and amplitude of the 480 KHz component. These four parameters can be varied based upon three characteristics of a coin—composition, thickness, and diameter. The parameters for each coin are unique, and each coin signature is characterized by the values of these four parameters, such as graphically illustrated in FIGS. 17 and 18, discussed below.

Figure 13:
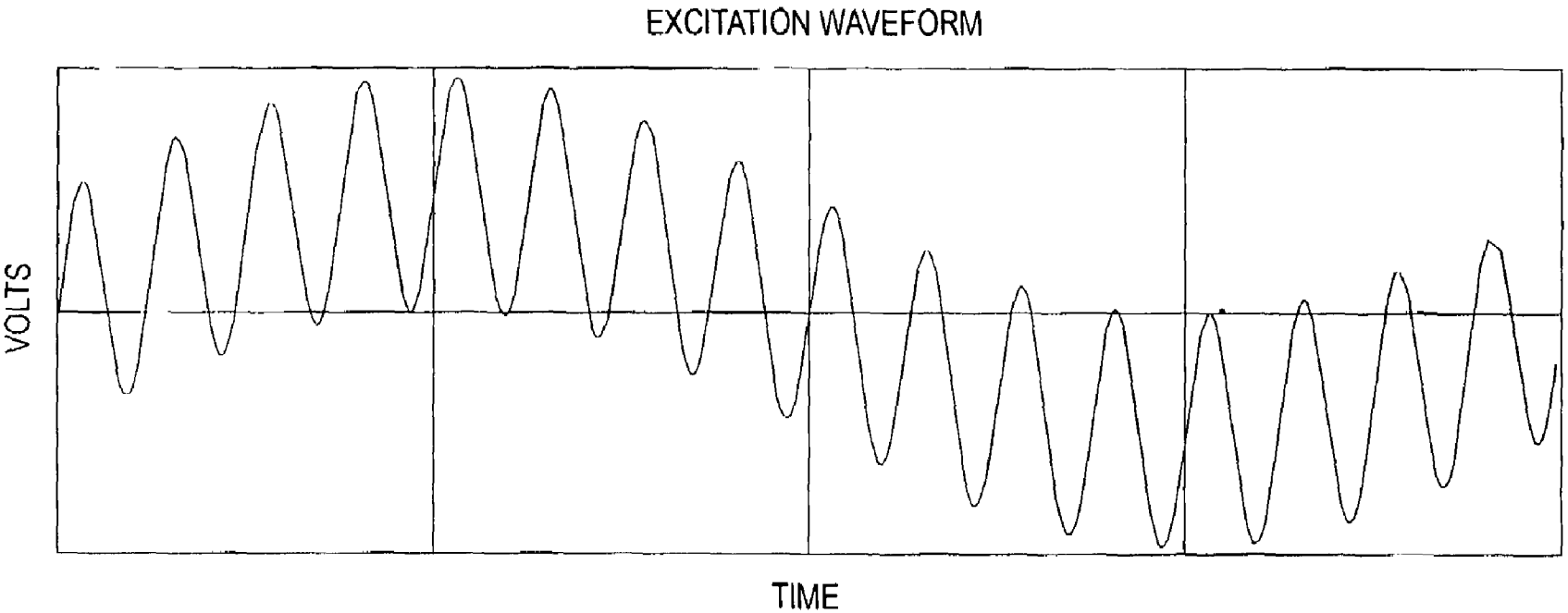
FIG. 13 is a graphical illustration of a waveform of an excitation signal which is provided to the coin discrimination sensor of FIG. 7.

FIGS. 13-16 graphically illustrate various waveforms which are generated according to one embodiment of the present invention. FIG. 13 is waveform of an excitation signal, such as the one outputted in FIG. 7 by the high frequency driver 316. The waveform is 10 volts peak-to-peak with a −5 volt minimum and +5 volt maximum. The waveform is a composite waveform comprised of a 30 KHz frequency component and a 480 KHz frequency component. Each of the 30 KHz and 480 KHz frequency components have a phase of 0 degrees and an amplitude of 2.0.

Figure 14:
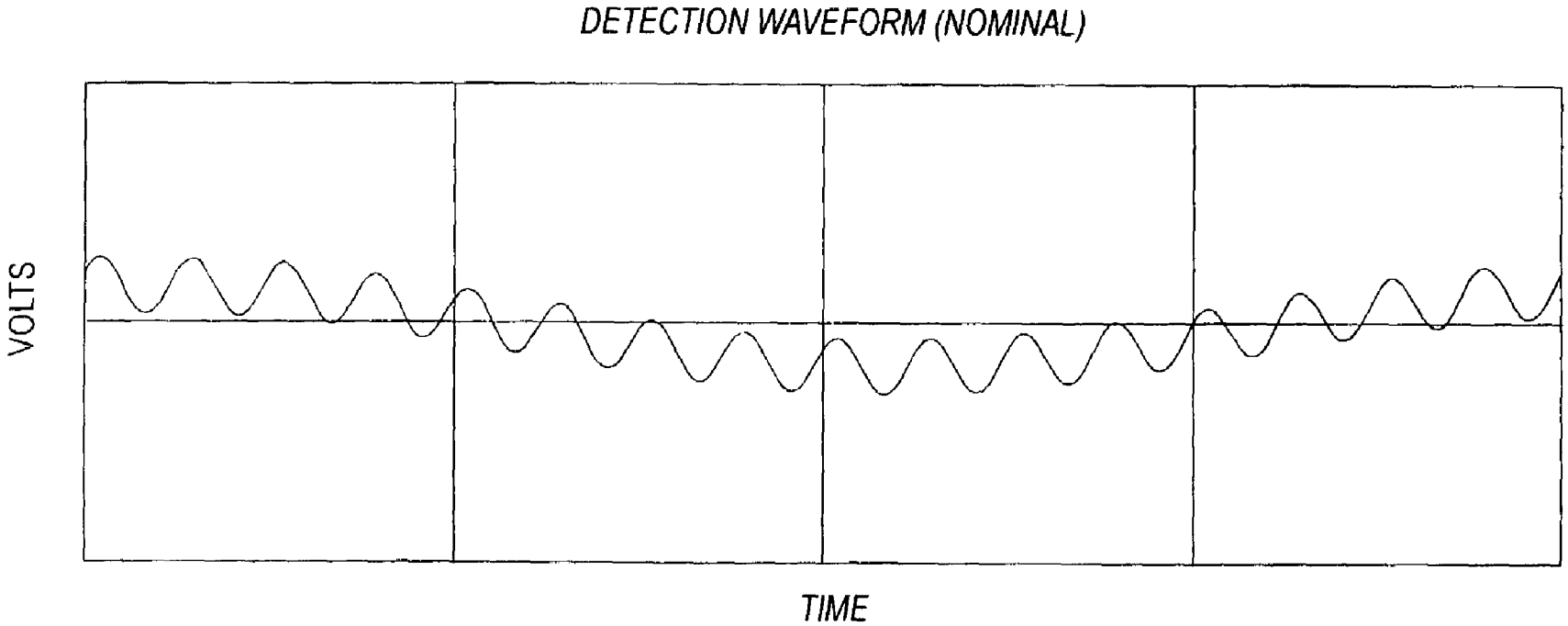
FIG. 14 is a graphical illustration of a waveform of a detection signal from the coin discrimination sensor of FIG. 7 when no coin is present.

FIG. 14 illustrates a waveform of a detection signal when no coin is present (nominal condition). The 30 KHz frequency component has a phase of about 74 degrees and an amplitude of about 0.687, and the 480 KHz frequency component has a phase of about 38 degrees and an amplitude of about 0.482.

Figure 15:
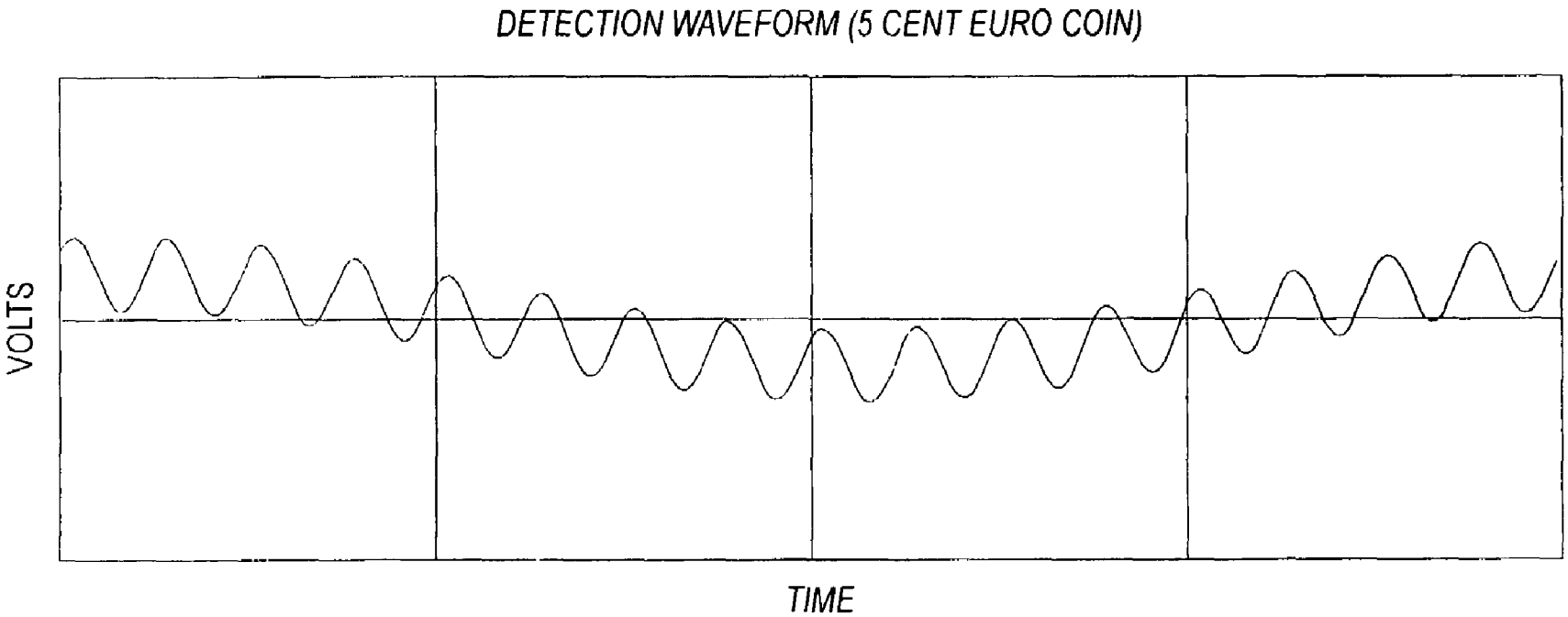
FIG. 15 is a graphical illustration of a waveform of a detection signal from the coin discrimination sensor of FIG. 7 when a 5 cent coin is present.

FIG. 15 is a waveform of a detection signal when a 5 cent coin is present. The 5 cent is comprised of a copper alloy, and therefore has a relatively high conductivity. The 30 KHz frequency component has a phase of about 78 degrees and an amplitude of about 0.787, and the 480 KHz frequency component has a phase of about 44 degrees and an amplitude of about 0.433.

Figure 16:
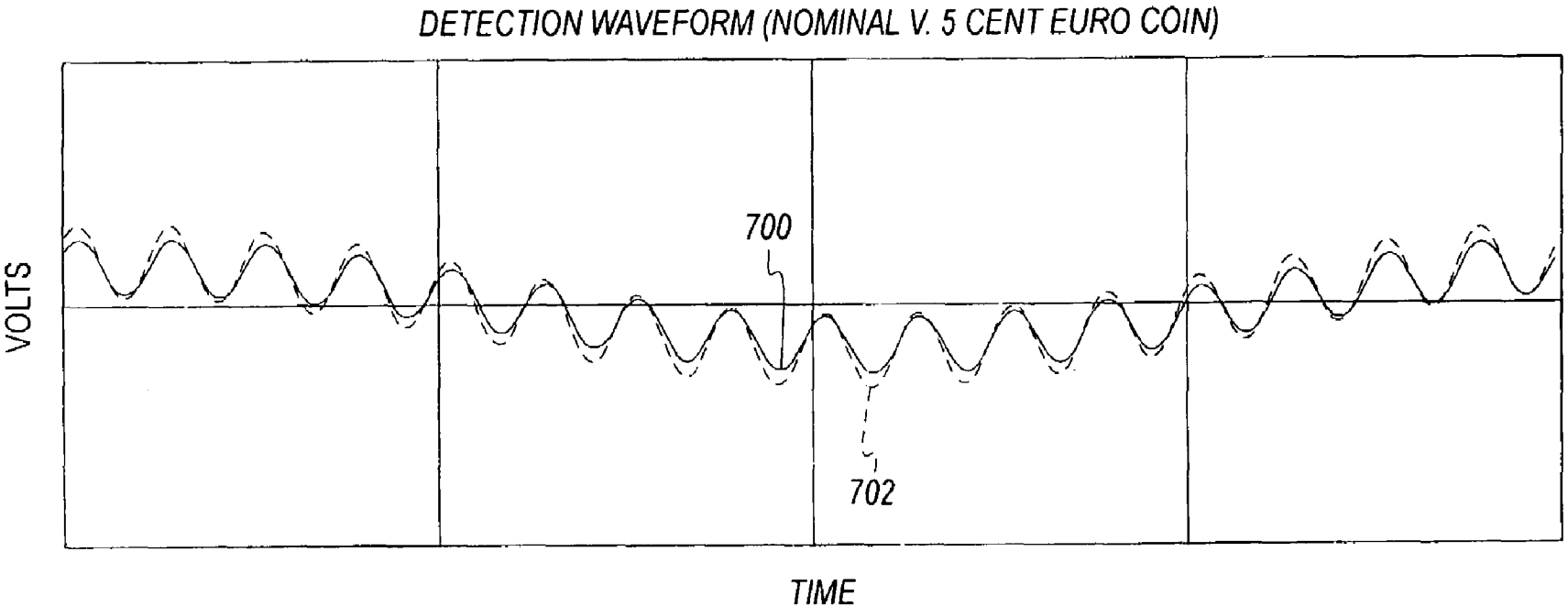
FIG. 16 is a graphical illustration of the two waveforms shown in FIGS. 14 and 15.

FIG. 16 illustrates the waveforms shown in FIGS. 14 and 15 superimposed one over the other. Waveform 700 corresponds to a detection signal when no coin is present, and waveform 702 corresponds to a detection signal when a 5 cent coin is present.

Figure 17:
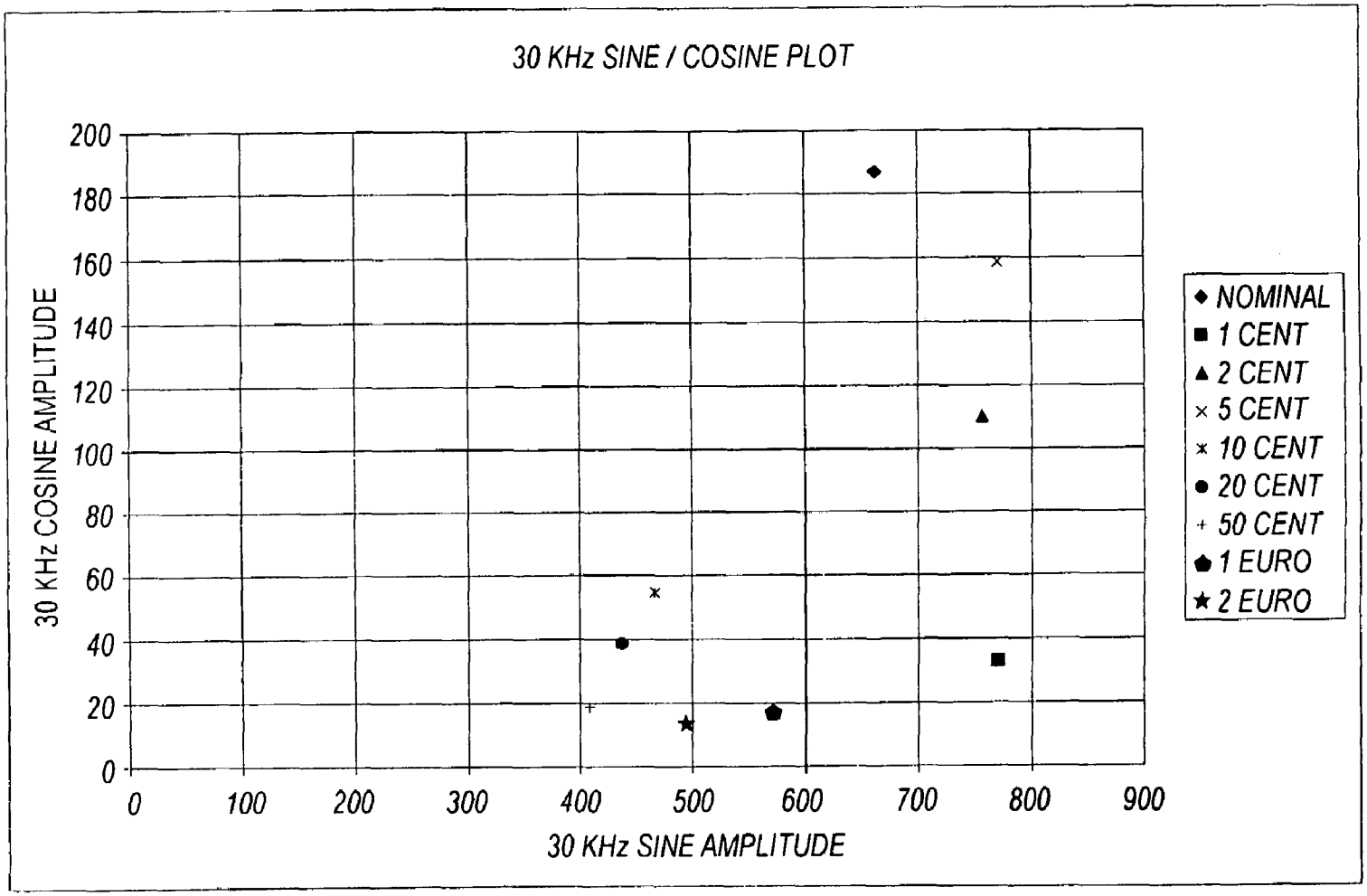
FIG. 17 is a scatter chart of the 30 KHz sine and cosine amplitude values for a coin set associated with the coin discrimination sensor of FIG. 7.
Figure 18:
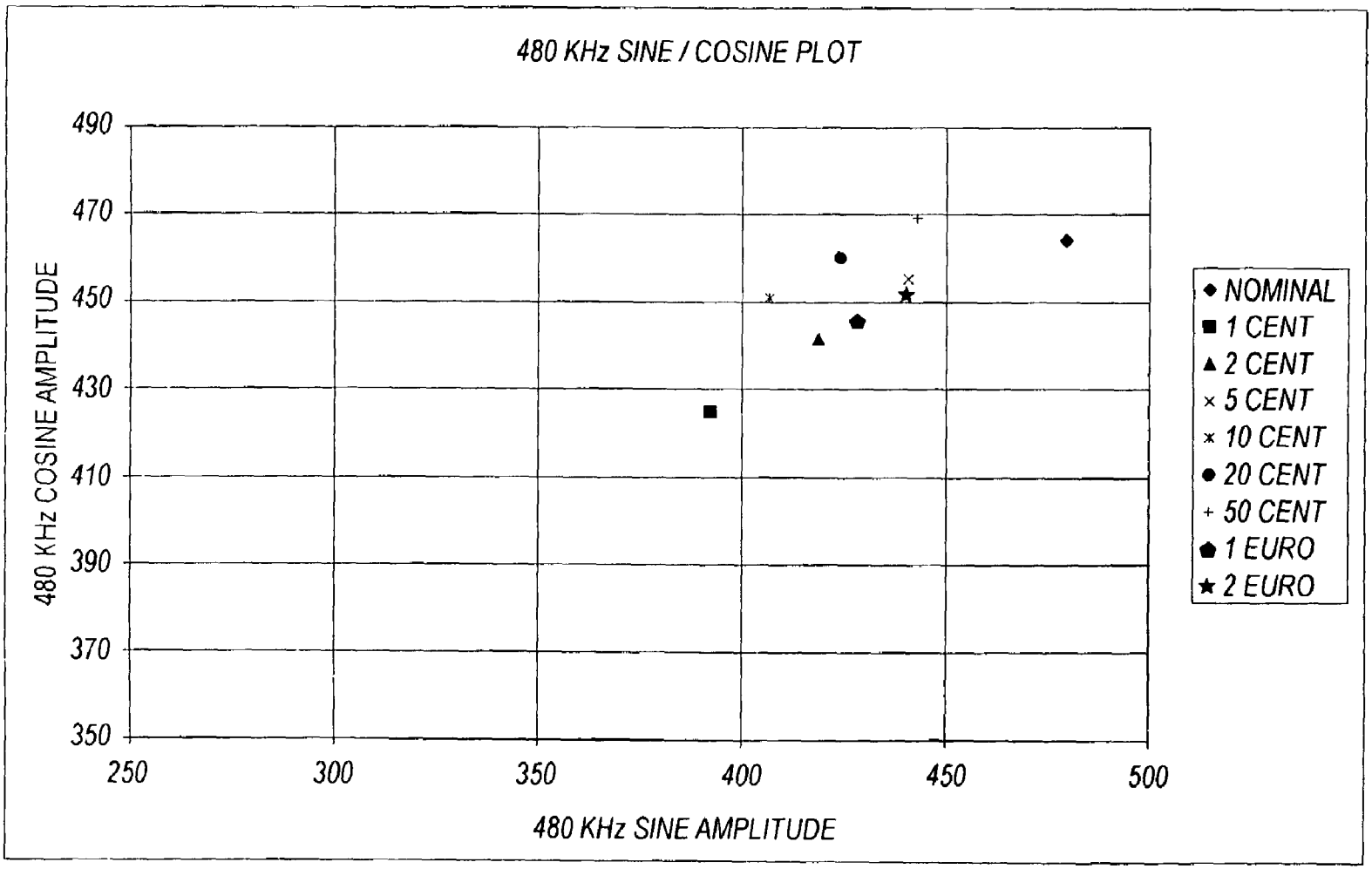
FIG. 18 is a scatter chart of the 480 KHz sine and cosine amplitude values for the coin set of FIG. 17.

Turning now to FIGS. 17 and 18, the amplitude values corresponding to each coin in a coin set are plotted on a chart. As is shown, each coin in the coin set generates a unique set of four values corresponding to each coin. Note that, for example, although the 480 KHz sine and cosine amplitudes for the 5 cent coin and the 2 Euro coin are relatively close in value (FIG. 18), the 30 KHz sine and cosine amplitude values for the same coins are significantly disparate (FIG. 17). By detecting coins according to three variables—composition, thickness, and diameter—the present invention reduces the probability that two different coins will generate the same coin signatures (i.e., have the same four values within a predetermined tolerance). Thus, the present invention offers a significant advantage over discrimination sensors that process coins based on an excitation signal oscillating at a single frequency, because such sensors are more likely to generate identical coin signatures for different coins.

It is understood that the coin set has been selected for illustrative purposes, and it will be appreciated that the present invention is not limited to processing the selected coins only. Rather, the discrimination sensor of the present invention may be employed to process any coin set, which may include any combination of coins and/or tokens.

Figure 19:
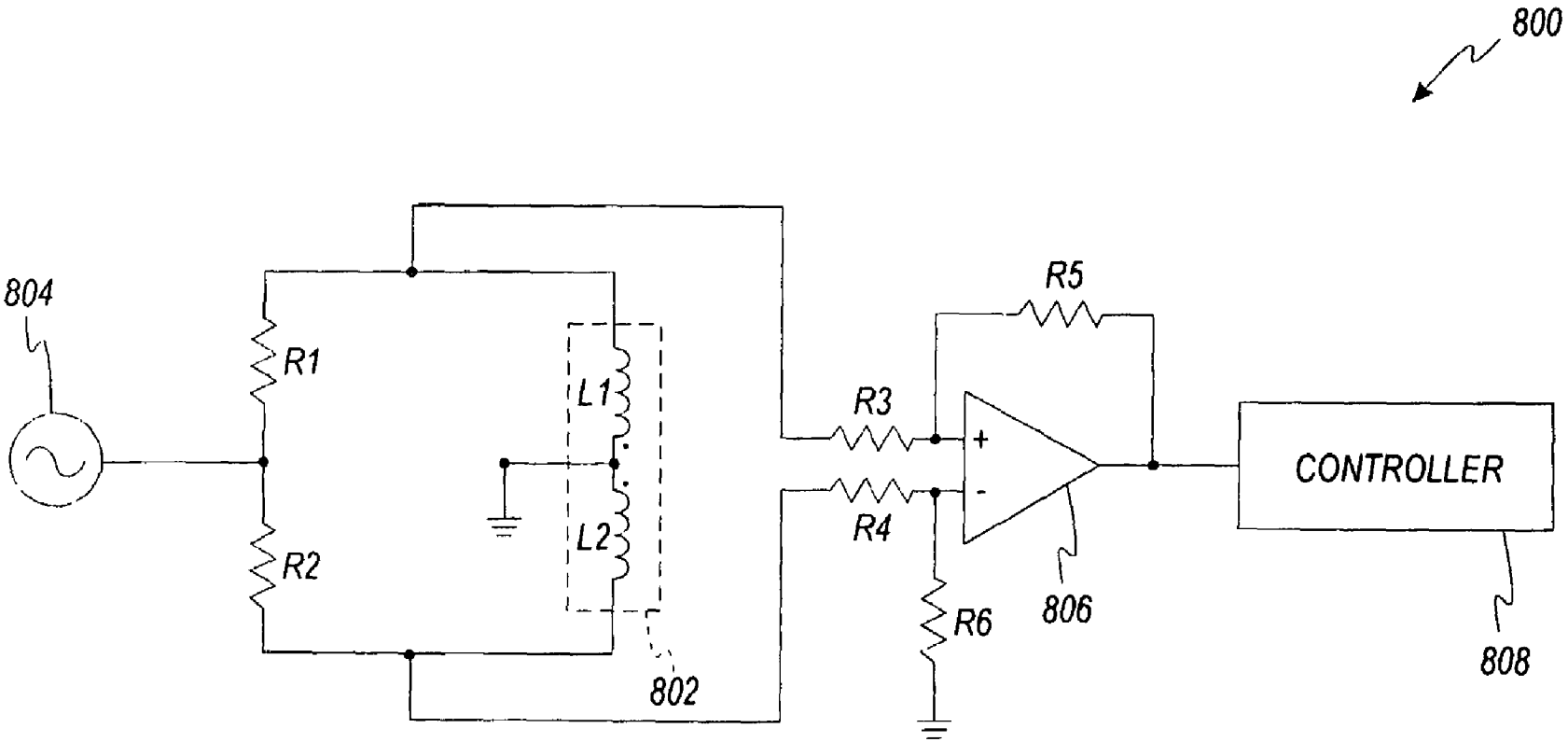
FIG. 19 is a functional block diagram of a coin discrimination system according to yet another embodiment of the present invention.

FIG. 19 illustrates yet another embodiment of a coin discrimination system 800 having a coin discrimination sensor 802 with only two coils L1 and L2 in a configuration commonly referred to as a Wheatstone bridge. A dual-frequency driver 804 drives the inputs to the coils L1 and L2. In one embodiment, the dual-frequency driver 804 may include the 30 KHz DDS sine wave generator 308, the 480 KHz DDS sine wave generator, the combiner 314, and the high frequency driver 316 shown in FIG. 7. In another embodiment, the dual-frequency driver 804 may include the 30 KHz sine wave generator 406, the 480 KHz sine wave generator 408, the combiner 410, and the buffer 412 shown in FIG. 8. In a specific embodiment, the coils L1 and L2 have an impedance of 150 μH. For maximum sensitivity, the values of R1 and R2 should be 28.3 ohms at 30 KHz to have the same impedance as 150 μH. Similarly, the values of R1 and R2 should be 452 ohms at 480 KHz to have the same impedance as 150 μH. Therefore, for maximum sensitivity, the values of R1 and R2 shown in FIG. 19 are 113 ohms, which represents the geometric mean of 28.3 ohms and 452 ohms. As is known, maximum sensitivity is achieved when the impedance levels of the resistors R1 and R2 match the inductive reactance of the coils L1 and L2.

The outputs of the coils L1 and L2 are provided to a differential amplifier 806. Preferably, the differential amplifier 806 has a high common-mode rejection ratio (CMRR). As is known, a high CMRR differential amplifier results in a small or negligible output signal when a zero differential voltage is applied across its input. In a specific embodiment, the differential amplifier 806 is an LT-1630 manufactured by Linear Technology. In a specific embodiment, the values of R3, R4, R5, and R6 are 1000 ohms accurate to within a +/−0.1% tolerance.

The output of the differential amplifier 806 is provided to a controller 808. In alternate embodiments, the output of the differential amplifier 806 may be provided to the ADC 324 shown in FIG. 7 or to the high bandpass filtuer 420 and low bandpass filter 422 shown in FIG. 8, and processed in accordance with the associated circuitry shown in FIGS. 7 and 8.

Figure 20:
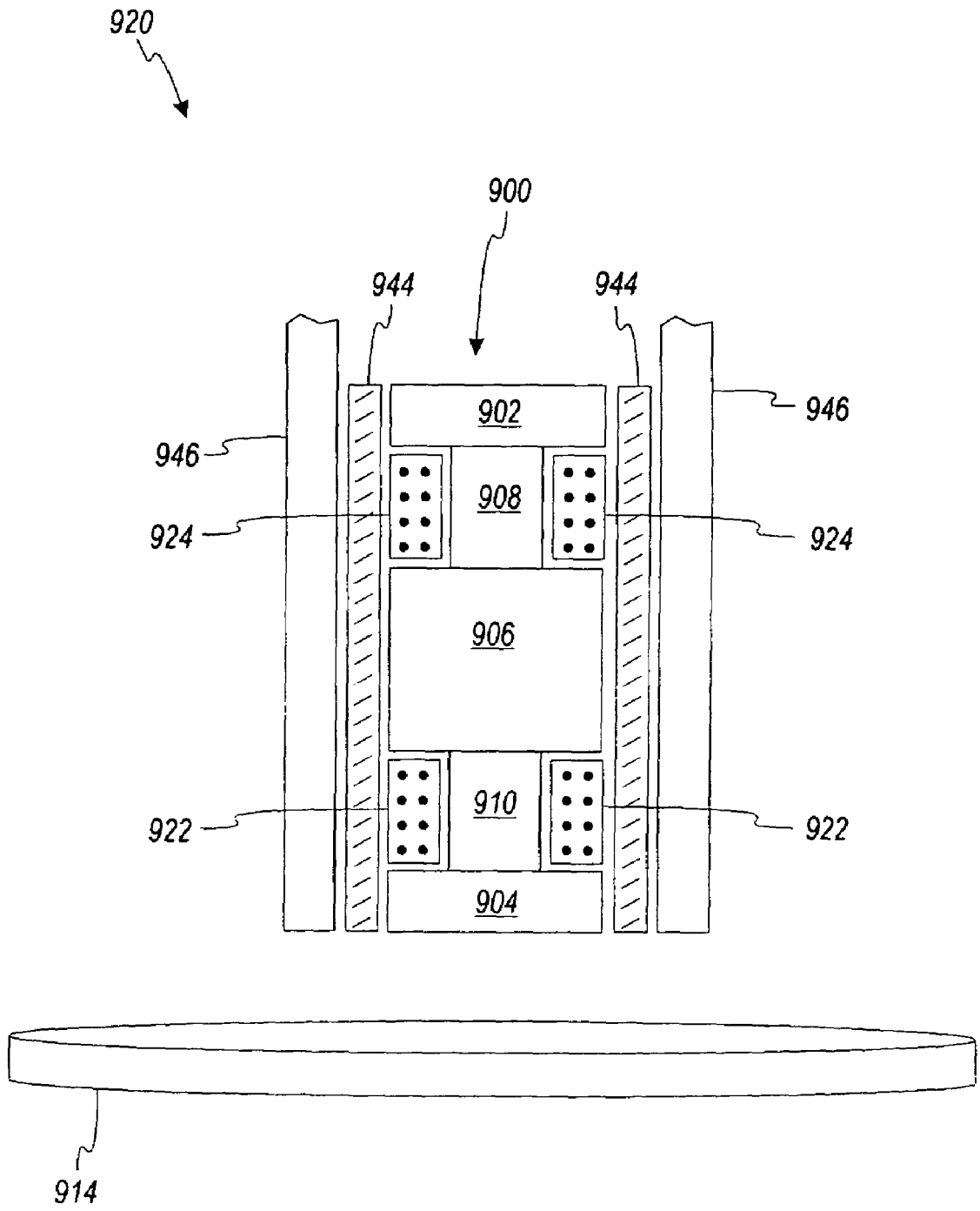
FIG. 20 is a diagrammatic cross-sectional view of the coin discrimination sensor shown in FIG. 19.

FIG. 20 is a cross-sectional view of a coin discrimination sensor 920 according to the embodiment shown in FIG. 19. The coin discrimination sensor 920 of FIG. 20 lacks the excitation coil 612 of the coin discrimination sensor 610 shown in FIG. 10. The coin discrimination sensor 920 includes a bobbin 900, a magnetic shield 944, and optionally an outer case 946. The bobbin 900 includes a top retaining layer 902, a bottom retaining layer 904, a projection 906, a first wire recess 908, and a second wire recess 910. A proximal detector coil 922 is wound around the second wire recess 910, and a distal detector coil 924 is wound around the first wire recess 908. The proximal detector coil 922 and the distal detector coil 924 correspond to the coils L1 and L2 shown in FIG. 19.

When a coin 914 passes by the coin discrimination sensor 920, the magnetic fields associated with the proximal detector coil 922 and the distal detector coil 924 will be disturbed differently, resulting in a voltage differential across the differential amplifier 806 shown in FIG. 19. The frequency components of the signal from the differential amplifier 806 are then analyzed separately and compared against known coin signature values and/or formulae in a lookup table as described above.

While the invention is susceptible to various modifications and alternative forms, specific embodiments have been shown by way of example in the drawings and described in detail herein. It should be understood, however, that the invention is not intended to be limited to the particular forms disclosed. Rather, the invention is to cover all modifications, equivalents and alternatives falling within the spirit and scope of the invention as defined by the appended claims.

What is claimed is:

1. A sensor assembly for determining an authenticity of coins, comprising:

an excitation device configured to receive an excitation signal having multiple fixed excitation frequency components and to produce a magnetic field over a coin path, said magnetic field coupling to said coins to induce eddy currents within said coin;

a reception device configured to receive first and second reception signals corresponding to said eddy currents, the voltage difference of said first and second reception signals being termed a detection signal, said detection signal having the same multiple fixed frequency components as said excitation signal; and first logic circuitry coupled to analog-to-digital (ADC) circuitry, said ADC circuitry coupled to said reception device, said first logic circuitry configured to produce a coin signature representing at least one of amplitudes and phase angles of said multiple fixed frequency components of said detection signal by application of a Fast Fourier Transform (FFT) to digital samples representing said detection signal, wherein said ADC circuitry is configured to sample said detection signal at a sampling frequency greater than a highest frequency of said multiple fixed excitation frequency components to produce digital samples representative of said detection signal.

2. The sensor assembly of claim 1, wherein said excitation device receives a composite signal having a fixed high fundamental excitation frequency component and a fixed low fundamental excitation frequency component.

3. The sensor assembly of claim 2, wherein said fixed high fundamental frequency component oscillates at a frequency at least eight times greater than the frequency at which said fixed low fundamental frequency component oscillates.

4. The sensor assembly of claim 1, wherein said sampling of said detection signal is at a rate of at least four samples per period of said detection signal.

5. The sensor assembly of claim 1, wherein said sampling of said detection signal is at a rate of 256 samples per period of detection signal.

6. The sensor assembly of claim 1, wherein said coin signature includes a first pair of coin signature values representing the amplitude of two phase angles of a low-frequency component of said multiple fixed frequency components and a second pair of coin signature values representing the amplitude of two phase angles of a high-frequency component of said multiple fixed frequency components.

7. The sensor assembly of claim 1, wherein said reception device comprises two reception coils.

8. The sensor assembly of claim 7, further comprising a bobbin made of a non-metallic material, wherein said reception coils circumscribe said bobbin.

9. The sensor assembly of claim 8, wherein said non-metallic material includes at least one of acetal resin, nylon, ceramic, or alumina.

10. The sensor assembly of claim 1, wherein said excitation device and said reception device are located on the same side of said coin path.

11. The sensor assembly of claim 1, wherein said coins include tokens.

12. A method of determining an authenticity of coins, comprising:

producing a magnetic field over a coin path, said magnetic field coupling to said coins to induce eddy currents within said coin at multiple fixed excitation frequencies;

detecting first and second reception signals corresponding to said eddy currents using a reception device, the voltage difference of said first and second reception signals being termed a raw detection signal, said raw detection signal having the same multiple fixed frequencies as said eddy currents within said coin;

producing a coin signature representing at least one of amplitudes and phase angles of multiple fixed frequency components of said raw detection signal by application of a Fast Fourier Transform (FFT) to digital samples representing said raw detection signal; and sampling said raw detection signal at a sampling frequency greater than a highest frequency of said multiple fixed excitation frequencies to produce digital samples representative of said raw detection signal.

13. The method of claim 12, wherein said sampling of said raw detection signal is at a rate of at least four samples per period of said raw detection signal.

14. The method of claim 12, wherein said coin signature includes a first pair of coin signature values representing the amplitude of two phase angles of a low-frequency component of said multiple fixed frequencies and a second pair of coin signature values representing the amplitude of two phase angles of a high-frequency component of said multiple fixed frequencies.

15. A sensor assembly for determining an authenticity of coins, comprising:

a transmission coil configured to receive an excitation signal having multiple fixed excitation frequency components including a low-frequency component and a high-frequency component, said transmission coil further configured to produce a magnetic field over a coin path, said magnetic field coupling to said coins to induce eddy currents within said coin;

two reception coils configured to detect respective first and second reception signals corresponding to said eddy currents, the voltage difference of said first and second reception signals being termed a raw detection signal, said raw detection signal having the same multiple fixed frequency components as said excitation signal;

an analog-to-digital converter (ADC) circuitry coupled to said two reception coils, said ADC circuitry configured to sample raw detection signal to produce digital samples representative of said raw detection signal; and first logic circuitry coupled to said ADC circuitry and configured to produce a coin signature representing amplitudes of respective multiple fixed frequency components of said raw detection signal by application of a Fast Fourier Transform (FFT) to digital samples representing said raw detection signal.

16. The sensor assembly of claim 15, wherein said coin signature includes a first pair of coin signature values representing the amplitude of two phase angles of said low-frequency component and a second pair of coin signature values representing the amplitude of two phase angles of said high-frequency component.

17. The sensor assembly of claim 16, wherein said two phase angles of said low-frequency component are about 90 degrees apart and said two phase angles of said high-frequency component are about 90 degrees apart.

18. The sensor assembly of claim 16, wherein said two phase angles of said low-frequency component are the sine and cosine positions of said low-frequency component and said two phase angles of said high-frequency component are the sine and cosine positions of said high-frequency component.

19. The sensor assembly of claim 15, further comprising a buffer between said ADC circuitry and said two reception coils, said buffer configured to amplify said raw detection signal before processing by said ADC circuitry.

20. The sensor assembly of claim 19, further comprising an encoder coupled to said ADC circuitry and configured to produce a signal indicating the presence or non-presence of a coin passing proximate said two reception coils.

21. The sensor assembly of claim 15, further comprising peak-detection circuitry coupled to said first logic circuitry and configured to detect the approximate center of a coin passing proximate said two reception coils and to store the coin signature corresponding to said approximate center.

22. The sensor assembly of claim 21, further comprising signature calibration control circuitry coupled to said peak-detection circuitry and configured to adjust a coin signature for at least one anomaly, said signature calibration control circuitry being further configured to store an adjusted coin signature based on said coin signature when said at least one anomaly is present.

23. The sensor assembly of claim 22, wherein said at least one anomaly is a calibration offset.

24. The sensor assembly of claim 22, wherein said at least one anomaly is a temperature drift.

25. The sensor assembly of claim 21, further comprising a coin data table that includes a set of coin data of at least one range of acceptable coin signature values, a coin having a coin signature falling within said at least one range being termed an acceptable coin.

26. The sensor assembly of claim 21, further comprising a coin data table that includes a set of curves along which acceptable coin signature values fall, a coin having a coin signature falling on a curve of said set of curves to within a desired tolerance being termed an acceptable coin.

27. The sensor assembly of claim 21, wherein said first logic circuitry includes a microprocessor programmed to enter into a learning mode that develops coin signature windows by application of said FFT.

28. The sensor assembly of claim 15, wherein said first logic circuitry is configured to produce at least about 30,000 coin signatures per second.

29. The sensor assembly of claim 15, wherein said coins include tokens.

30. The sensor assembly of claim 15, wherein said high-frequency component oscillates at a frequency at least eight times greater than the frequency at which said low-frequency component oscillates.

31. A method of determining an authenticity of coins, the method comprising:

producing a magnetic field over a coin path, said magnetic field associated with multiple fixed excitation frequencies, said magnetic field coupling to said coins to induce eddy currents within said coin;

detecting first and second reception signals corresponding to said eddy currents using respective first and second reception coils, the voltage difference of said first and second reception signals being termed a raw detection signal, said raw detection signal having the same multiple fixed frequencies associated with said magnetic field;

sampling, using an analog-to-digital converter, said raw detection signal to produce digital samples representative thereof; and producing a coin signature representing amplitudes of respective multiple fixed frequencies for said raw detection signal by application of a Fast Fourier Transform (FFT) to said digital samples representing said raw detection signal.

32. The sensor assembly of claim 31, wherein said coin signature includes a first pair of coin signature values representing the amplitude of two phase angles of a low-frequency component of said multiple fixed frequencies and a second pair of coin signature values representing the amplitude of two phase angles of a high-frequency component of said multiple fixed frequencies.

33. The sensor assembly of claim 32, wherein said two phase angles of said low-frequency component are about 90 degrees apart and said two phase angles of said high-frequency component are about 90 degrees apart.

34. The sensor assembly of claim 32, wherein said two phase angles of said low-frequency component are the sine and cosine positions of said low-frequency component and said two phase angles of said high-frequency component are the sine and cosine positions of said high-frequency component.

35. The sensor assembly of claim 31, further comprising amplifying said raw detection signal prior to sampling using said analog-to-digital converter.

36. The sensor assembly of claim 31, further comprising peak detecting to detect the approximate center of a coin passing proximate said two reception coils and storing the coin signature corresponding to said approximate center.

37. The sensor assembly of claim 31, further comprising adjusting said coin signature for at least one anomaly and storing an adjusted coin signature based on said coin signature when said at least one anomaly is present.

38. The sensor assembly of claim 31, further comprising learning a new set of coin signatures by application of said FFT and storing at least one new coin signature window based on said learning.

39. A sensor assembly for determining an authenticity of coins, comprising:

a transmission coil configured to produce a magnetic field over a coin path responsive to a composite signal representing the combination of fixed high-frequency signals and fixed low-frequency signals, said magnetic field coupling to said coins to induce eddy currents within said coin;

two reception coils configured to detect respective first and second reception signals corresponding to said eddy currents, the voltage difference of said first and second reception signals being termed a raw detection signal, wherein said raw detection signal has the same combination of fixed high-frequency signals and fixed low-frequency signals as said composite signal;

analog-to-digital converter circuitry having an input that receives said raw detection signal and an output that produces digital samples representative of said raw detection signal; and logic circuitry coupled to said two reception coils and configured to produce a coin signature representing amplitudes of respective low- and high-frequency components of said raw detection signal by applying a Fast Fourier Transform (FFT) algorithm on said digital samples.

* * * * *